US009327815B2

(12) United States Patent
Uenoyama et al.

(10) Patent No.: US 9,327,815 B2
(45) Date of Patent: May 3, 2016

(54) OUTBOARD MOTOR

(71) Applicant: YAMAHA HATSUDOKI KABUSHIKI KAISHA, Iwata-shi, Shizuoka (JP)

(72) Inventors: Masashi Uenoyama, Shizuoka (JP); Ryotaro Yasumura, Shizuoka (JP); Koushirou Inaba, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 14/525,242

(22) Filed: Oct. 28, 2014

(65) Prior Publication Data

US 2015/0239544 A1 Aug. 27, 2015

(30) Foreign Application Priority Data

Feb. 27, 2014 (JP) ..... 2014-036837

(51) Int. Cl.
*B63H 20/14* (2006.01)
*B63H 20/20* (2006.01)
*B63J 99/00* (2009.01)

(52) U.S. Cl.
CPC ..... *B63H 20/20* (2013.01); *B63J 99/00* (2013.01); *B63J 2099/006* (2013.01)

(58) Field of Classification Search
CPC ..... B63H 20/20; B63H 20/30; B63H 20/32
USPC ..... 440/75
See application file for complete search history.

(56) References Cited

U.S. PATENT DOCUMENTS 5,445,546 A * 8/1995 Nakamura ..... B63H 21/265 192/21
6,123,591 A * 9/2000 Onoue ..... B63H 21/28 192/48.91
2009/0209150 A1 8/2009 Yukishima

FOREIGN PATENT DOCUMENTS

JP 2009-190653 A 8/2009

* cited by examiner

*Primary Examiner* — Stephen Avila
(74) *Attorney, Agent, or Firm* — Keating and Bennett, LLP

(57) ABSTRACT

A dog clutch selectively meshes with a forward gear and a reverse gear according to an operation of a shift operating member such that connection of the forward gear or the reverse gear to a propeller shaft is changed. A friction clutch transmits the rotation of a drive shaft to the propeller shaft by a first friction surface and a second friction surface contacting together. Before a shifting stage in which the dog clutch meshes with the forward gear or with the reverse gear, a control unit is configured or programmed to control an actuator so as to execute synchronization control by making the first friction surface and the second friction surface of the friction clutch contact one another.

10 Claims, 14 Drawing Sheets

OUTBOARD MOTOR

BACKGROUND OF THE INVENTION

1. Field of the Invention

The present invention relates to an outboard motor.

2. Description of the Related Art

An outboard motor includes a shifting mechanism configured to change transmission of power from the engine to the propeller shaft to any one of forward, reverse, and neutral. Such a shifting mechanism includes a dog clutch, a forward gear, and a reverse gear. The shifting mechanism changes the direction in which power is transmitted to the propeller shaft by changing between connecting the dog clutch and the forward gear, and connecting the dog clutch and the reverse gear.

When the dog clutch and the forward gear become meshed together, a rotational speed difference may exist between the dog clutch and the forward gear. Due to this configuration, it is not easy to mesh the dog clutch and the forward gear together smoothly, and in some cases a shift shock is generated. In a similar manner, when the dog clutch and the reverse gear become meshed together, in some cases a shift shock is generated due to a rotational speed difference between the dog clutch and the reverse gear.

In order to suppress this type of shift shock, for example, the shifting mechanism of the outboard motor of Japanese Laid-Open Patent Publication 2009-190653 is equipped with a cone clutch. The cone clutch is disposed in line with the dog clutch along the direction of the axial line of the drive shaft, and is coupled to the dog clutch. Before the dog clutch and the forward gear mesh together, or the dog clutch and the reverse gear mesh together, the cone clutch frictionally engages against a contacting surface that is provided on the forward gear or on the reverse gear. In Japanese Laid-Open Patent Publication 2009-190653, it is explained that, due to this operation of the cone clutch, it is possible for the dog clutch and the forward gear, or the dog clutch and the reverse gear, to become meshed together in a state in which the rotation of the dog clutch and the rotation of the forward gear, or the rotation of the reverse gear, have been synchronized.

SUMMARY OF THE INVENTION

However, it is not easy to sufficiently synchronize the rotation of the dog clutch with the rotation of the forward gear, or with the rotation of the reverse gear, since the friction surface of the cone clutch that frictionally contacts against the contacting surface of the forward gear, or against the contacting surface of the reverse gear, is small. Due to this configuration, it is necessary for the steersman to adjust the frictional state of the cone clutch by appropriately operating the shift lever until the rotation of the dog clutch has become sufficiently synchronized with the rotation of the forward gear, or with the rotation of the reverse gear. However, this type of operation is complicated and is not desirable.

Moreover, in Japanese Laid-Open Patent Publication 2009-190653, it is disclosed that it is possible to mesh the dog clutch smoothly with the forward gear or with the reverse gear, provided that the synchronized rotational speed of the dog clutch is around 20% to 30% of the rotational speed of the forward gear, or the rotational speed of the reverse gear. However, in actual practice, in order to mesh the dog clutch smoothly with the forward gear or with the reverse gear, it is necessary to synchronize the rotational speed of the dog clutch better than above, and to make the rotational speed difference smaller than that disclosed in Japanese Laid-Open Patent Publication 2009-190653. Due to this, it is necessary to perform a more complicated operation of the type described above with the shift lever.

Preferred embodiments of the present invention provide an outboard motor that significantly reduces or prevents shift shock with a simple operation.

The outboard motor according to a preferred embodiment of the present invention includes an engine, a drive shaft, a drive gear, a propeller shaft, a forward gear, a reverse gear, a shift operating member, a dog clutch, a friction clutch, an actuator, and a control unit. The drive shaft extends downward from the engine. The drive gear is fixed to the drive shaft. The propeller shaft extends in a direction that intersects the drive shaft. The forward gear meshes with the drive gear. The reverse gear meshes with the drive gear. The shift operating member is configured to change between forward and reverse. The dog clutch is disposed on the propeller shaft. The dog clutch changes between connecting the forward gear to the propeller shaft and connecting the reverse gear to the propeller shaft by selectively meshing with the forward gear or the reverse gear according to operation of the shift operating member. The friction clutch includes a first friction surface that transmits rotation of the drive shaft and a second friction surface that transmits rotation of the propeller shaft. The friction clutch transmits rotation of the drive shaft to the propeller shaft by the first friction surface and the second friction surface contacting together. The actuator drives the friction clutch. The control unit is configured or programmed, before a shifting stage in which the dog clutch meshes with the forward gear or with the reverse gear, to execute synchronization control by controlling the actuator to contact the first friction surface and the second friction surface of the friction clutch together.

According to the various preferred embodiments of the present invention, it is possible to perform synchronization control at a high accuracy with the friction clutch by the control unit controlling the actuator. Due to this configuration, it is possible to significantly reduce or prevent shift shock with a simple operation.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
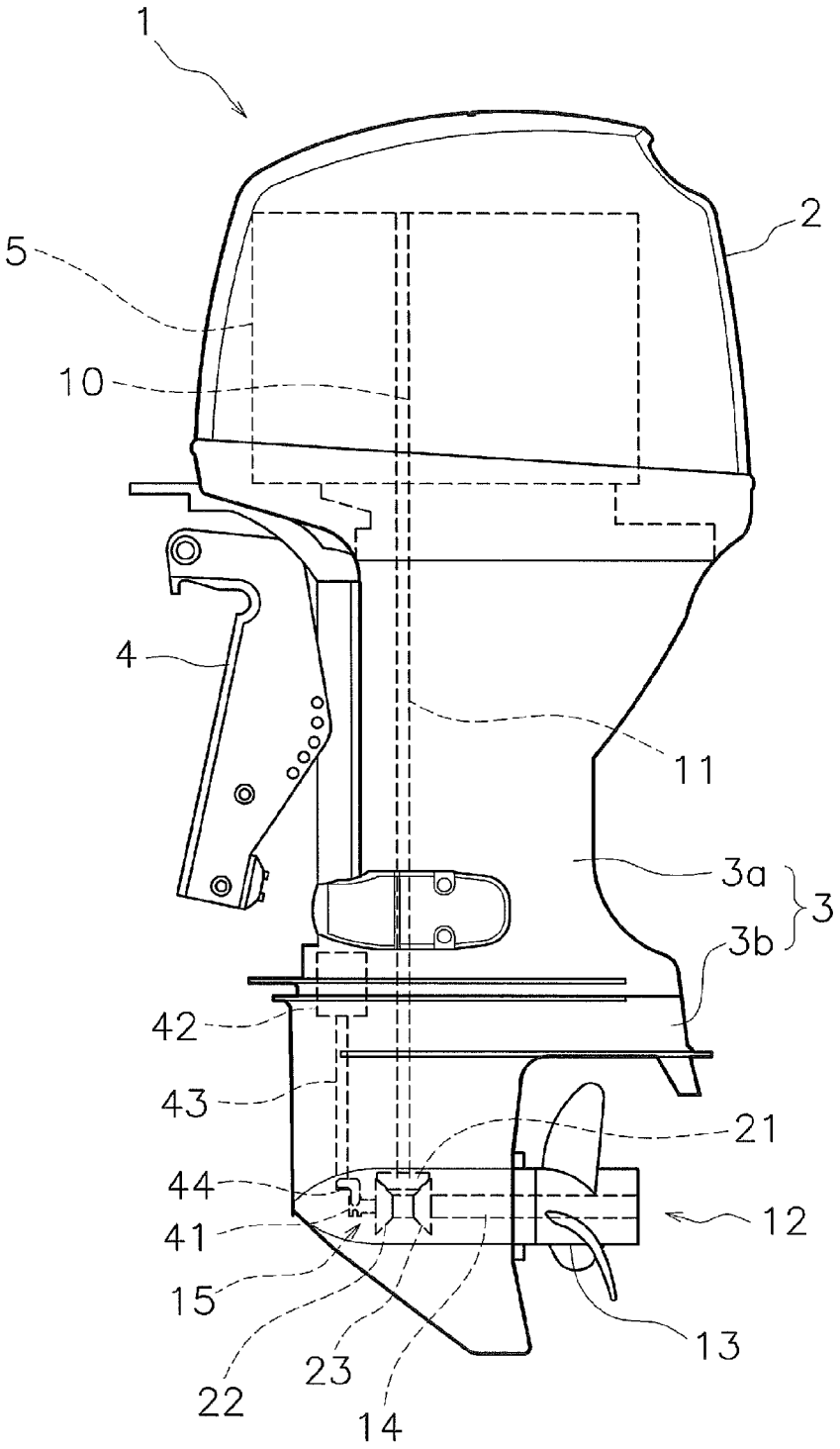
FIG. 1 is a side view of an outboard motor according to a preferred embodiment of the present invention.

An outboard motor according to various preferred embodiments of the present invention will now be explained with reference to the drawings. FIG. 1 is a side view of the outboard motor 1 according to a preferred embodiment of the present invention. The outboard motor 1 includes an engine cover 2, a casing 3, a bracket 4, and an engine 5. The engine cover 2 houses the engine 5. The casing 3 is disposed under the engine cover 2. The outboard motor 1 is attached to the hull of a vessel via the bracket 4.

The engine 5 is disposed within the engine cover 2. The engine 5 includes a crankshaft 10. The crankshaft 10 extends in the vertical direction. A drive shaft 11 is disposed within the casing 3. The drive shaft 11 extends downward from the engine 5, and extends in the vertical direction in the interior of the casing 3. The drive shaft 11 is fixed to the crankshaft 10.

The casing 3 includes an upper casing 3*a* and a lower casing 3*b*. The upper casing 3*a* is disposed below the engine cover 2. The upper casing 3*a* is disposed between the engine cover 2 and the lower casing 3*b*. The lower casing 3*b* is disposed under the upper casing 3*a*.

A propeller 12 is disposed at the lower portion of the lower casing 3*b*. The propeller 12 is disposed underneath the engine 5. The propeller 12 includes a propeller boss 13. A propeller shaft 14 is disposed in the interior of the propeller boss 13. The propeller shaft 14 extends in a direction that intersects the drive shaft 11. In other words, the propeller shaft 14 extends along the front-back direction.

The outboard motor 1 includes a shifting mechanism 15. The propeller shaft 14 is connected to the drive shaft 11 via the shifting mechanism 15. The propeller shaft 14 transmits a drive force from the drive shaft 11 to the propeller 6. The shifting mechanism 15 changes the rotational direction of the power that is transmitted from the drive shaft 11 to the propeller shaft 14. The shifting mechanism 15 thus changes the direction of rotation of the propeller 6 between the direction to drive the hull to which the outboard motor 1 is mounted forward, and the direction to drive it in reverse.

Figure 2:
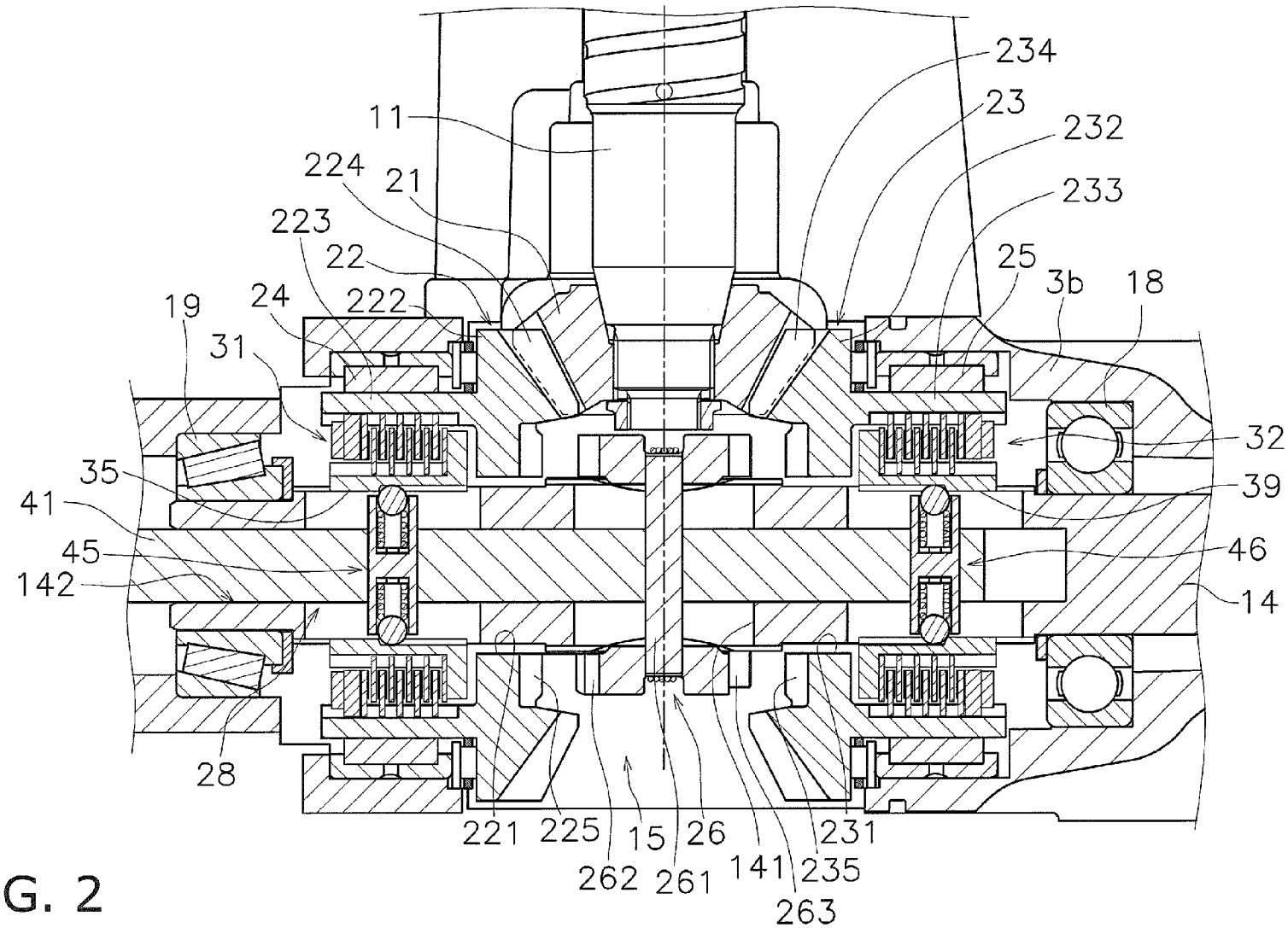
FIG. 2 is a sectional view showing a shifting mechanism in a state in which a shift shaft is positioned at a neutral position.

FIG. 2 is a sectional view showing the structure within the lower casing 3*b*. As shown in FIG. 2, the propeller shaft 14 is housed within the lower casing 3*b*. The propeller shaft 14 is rotatably supported by the lower casing 3*b* via bearings 18 and 19.

The shifting mechanism 15 includes a drive gear 21, a forward gear 22, and a reverse gear 23. The drive gear 21 is fixed to the lower end portion of the drive shaft 11. The forward gear 22 and the reverse gear 23 are disposed in sequence along the front-back direction. In other words, the forward gear 22 and the reverse gear 23 are disposed in sequence along the direction of the axial line of the propeller shaft 14 (subsequently this will be termed the "propeller shaft axial direction"). The forward gear 22 and the reverse gear 23 are arranged to be coaxial with the propeller shaft 14. The drive gear 21 is disposed between the forward gear 22 and the reverse gear 23, and meshes with the forward gear 22 and with the reverse gear 23.

The forward gear 22 includes a through hole 221. The reverse gear 23 includes a through hole 231. The propeller shaft 14 is inserted through the through hole 221 of the forward gear 22 and also through the through hole 231 of the reverse gear 23. The forward gear 22 is provided on the propeller shaft 14 so as to be rotatable thereupon. Moreover, the forward gear 22 is provided on the propeller shaft 14 so as to shift along the propeller shaft axial direction. The reverse gear 23 is provided on the propeller shaft 14 so as to be rotatable thereupon. Moreover, the reverse gear 23 is provided on the propeller shaft 14 so as to shift along the propeller shaft axial direction.

The forward gear 22 includes a gear portion 222 and a tubular portion 223. The gear portion 222 includes a toothed portion 222 and a dog portion 225. The toothed portion 224 meshes with the drive gear 21 described above. The drive gear 21 and the toothed portion 224 are preferably both bevel gears. The dog portion 225 is positioned radially inward from the toothed portion 224. The dog portion 225 meshes with a dog clutch 26 that will be described hereinafter. The tubular portion 223 projects from the gear portion 222 along the propeller shaft axial direction. The tubular portion 223 is rotatably supported by the lower casing 3*b* via a bearing 24.

Similarly, the reverse gear 23 includes a gear portion 232 and a tubular portion 233. The gear portion 232 includes a toothed portion 234 and a dog portion 235. The toothed portion 234 meshes with the drive gear 21 described above. The toothed portion 234 is preferably a bevel gear. The dog portion 235 is positioned radially inward from the toothed portion 234. The dog portion 235 meshes with the dog clutch 26 described hereinafter. The tubular portion 233 is rotatably supported by the lower casing 3*b* via a bearing 25. The tubular portion 233 projects from the gear portion 232 along the propeller shaft axial direction.

The shifting mechanism 15 includes the dog clutch 26, friction clutches 31 and 32, and a connection changeover mechanism 28. The dog clutch 26 is configured to change between connecting the propeller shaft 14 to the forward gear 22, and connecting the propeller shaft 14 to the reverse gear 23. The dog clutch 26 is disposed on the propeller shaft 14. The dog clutch 26 is disposed between the forward gear 22 and the reverse gear 23. The dog clutch 26 is fitted on the propeller shaft 14 so that it cannot rotate thereupon. Accordingly, the dog clutch 26 rotates together with the propeller shaft 14. Moreover, the dog clutch 26 is mounted on the propeller shaft 14 so as to shift along the propeller shaft axial direction.

The dog clutch 26 includes a shaft portion 261, a forward dog portion 262, and a reverse dog portion 263. The propeller shaft 14 includes a hole 141 that pierces through the propeller shaft 14 in the diametrical direction. The hole 141 is a slot that extends along the propeller shaft axial direction. The shaft portion 261 of the dog clutch 261 is inserted through the hole 141 in the propeller shaft 14. Along the propeller shaft axial direction, the forward dog portion 262 faces the dog portion 225 of the forward gear 22. Similarly, along the propeller shaft axial direction, the reverse dog portion 263 faces the dog portion 235 of the reverse gear 23.

The friction clutches 31 and 32 transmit the rotation of the drive shaft 11 to the propeller shaft 14 by frictional force. The friction clutches 31 and 32 include a forward clutch 31 and a reverse clutch 32. The forward clutch 31 and the reverse clutch 32 are disposed in sequence along the propeller shaft axial direction with the dog clutch 26. The forward clutch 31 transmits the rotation of the forward gear 22 to the propeller shaft 14 by frictional force. The forward clutch 31 is disposed between the forward gear 22 and the propeller shaft 14. The reverse clutch 32 transmits the rotation of the reverse gear 23 to the propeller shaft 14 by frictional force. The reverse clutch 32 is disposed between the reverse gear 23 and the propeller shaft 14.

Figure 3:
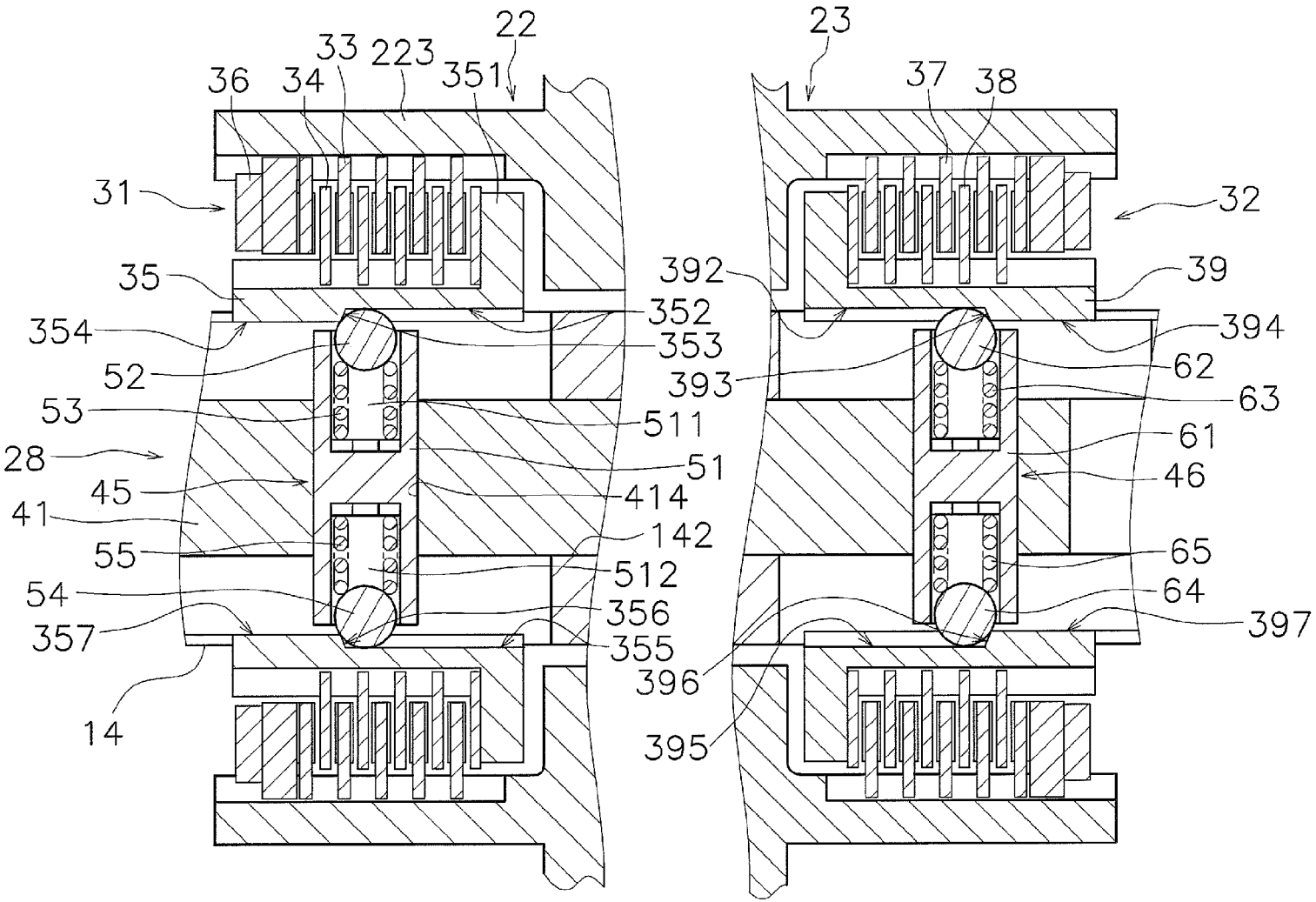
FIG. 3 is an enlarged view of the shifting mechanism in the state in which the shift shaft is positioned at the neutral position.

FIG. 3 is an enlarged view of the shifting mechanism 15. As shown in FIG. 3, the forward clutch 31 includes a plurality of first clutch plates 33 and 34 and a first clutch piston 35. The plurality of first clutch plates 33 and 34 include a plurality of outer first clutch plates 33 and a plurality of inner first clutch plates 34. It should be understood that, in FIG. 3, a reference symbol 33 is appended to only one of the outer first clutch plates 33, while reference symbols for the other outer first clutch plates 33 are omitted. Similarly, a reference symbol 34 is appended to only one of the inner first clutch plates 34, while reference symbols for the other inner first clutch plates 34 are omitted. The outer first clutch plates 33 and the inner first clutch plates 34 are arranged alternatingly along the propeller shaft axial direction.

The first clutch piston 35 includes a tubular shaped portion. The first clutch piston 35 is mounted on the propeller shaft 14 so as to shift along the propeller shaft axial direction. The first clutch piston 35 is mounted on the propeller shaft 14 so as not to be rotatable with respect to the propeller shaft 14. Accordingly, the first clutch piston 35 rotates together with the propeller shaft 14. For example, the first clutch piston 35 may be splined to the outer circumferential surface of the propeller shaft 14.

The outer first clutch plates 33 are fitted to the inner circumferential surface of the tubular portion 223 of the forward gear 22. The outer first clutch plates 33 are mounted in the tubular portion 223 of the forward gear 22 so as to shift along the propeller shaft axial direction. A retainer member 36 is attached to the tubular portion 223 of the forward gear 22. The retainer member 36 is configured so that the outer first clutch plates 33 cannot detach from the tubular portion 223 of the forward gear 22. The outer first clutch plates 33 are mounted in the tubular portion 223 of the forward gear 22 so as not to be rotatable with respect thereto. For example, the outer first clutch plates 33 may be splined to the inner circumferential surface of the tubular portion 223 of the forward gear 22. Accordingly, the outer first clutch plates 33 rotate together with the tubular portion 223 of the forward gear 22.

The inner first clutch plates 34 are fitted to the outer circumferential surface of the first clutch piston 35. The inner first clutch plates 34 are mounted to the first clutch piston 35 so as to shift along the propeller shaft axial direction with respect thereto. Moreover, the inner first clutch plates 34 are mounted to the first clutch piston 35 so as not to be rotatable with respect thereto. Accordingly, the inner first clutch plates 34 rotate together with the first clutch piston 35. For example, the inner first clutch plates 34 may be splined to the outer circumferential surface of the first clutch piston 35. The inner first clutch plates 34 rotate together with the first clutch piston 35 and the propeller shaft 14.

The first clutch piston 35 includes a flange portion 351. The flange portion 351 opposes the plurality of first clutch plates 33 and 34 along the propeller shaft axial direction. The flange portion 351 presses the inner first clutch plates 34 toward the outer first clutch plates 33 due to the first clutch piston 35 shifting along the propeller shaft axial direction. Due to this configuration, the outer first clutch plates 33 and the inner first clutch plates 34 are contacted together, and the forward clutch 31 is put into a connected state. Accordingly, the surfaces of the outer first clutch plates 33 correspond to first friction surfaces that transmit the rotation of the drive shaft 11. Moreover, the surfaces of the inner first clutch plates 34 correspond to second friction surfaces that transmit the rotation of the drive shaft 11. It should be understood that, in the state in which the flange portion 351 does not press upon the inner first clutch plates 34, due to the action of lubricating oil or the like, the inner first clutch plates 34 and the outer first clutch plates 33 operate so as to be mutually disengaged.

The reverse clutch 32 includes a structure similar to that of the forward clutch 31. The reverse clutch 32 includes a plurality of second clutch plates 37 and 38 and a second clutch piston 39 that presses upon the second clutch plates 37 and 38. The plurality of second clutch plates 37 and 38 include a plurality of outer second clutch plates 37 and a plurality of inner second clutch plates 38. It should be understood that, in FIG. 3, a reference symbol 37 is appended to only one of the outer second clutch plates 37, while reference symbols for the other outer second clutch plates 37 are omitted. Similarly, a reference symbol 38 is appended to only one of the inner second clutch plates 38, while reference symbols for the other inner second clutch plates 38 are omitted.

The outer second clutch plates 37 have a structure similar to that of the outer first clutch plates 33 described above. The inner second clutch plates 38 have a structure similar to that of the inner first clutch plates 34 described above. Moreover, the second clutch piston 39 includes a structure similar to that of the first clutch piston 35 described above. Accordingly, detailed explanation of the reverse clutch 32 will be omitted.

The connection changeover mechanism 28 changes the connections of the dog clutch 26 and the connections of the friction clutches 31 and 32. The connection changeover mechanism 28 includes a shift shaft 41. The shift shaft 41 is disposed within the lower casing **3*b*. The shift shaft 41 is disposed so as to extend along the propeller shaft axial direction. In more detail, the propeller shaft 14 includes a hole 142 that extends along the propeller shaft axial direction. The shift shaft 41 is disposed in the hole 142 of the propeller shaft 14. As shown in FIG. 2, one end of the shift shaft 41 projects out from the hole 142 of the propeller shaft 14 along the propeller shaft axial direction. The shift shaft 41 is configured to shift along the propeller shaft axial direction. The connection changeover mechanism 28 changes the connection between the dog clutch 26 and the forward gear 22, the connection of the forward clutch 31, the connection between the dog clutch 26 and the reverse gear 23, and the connection of the reverse clutch 32 according to the position of the shift shaft 41**.

As shown in FIG. 1, the shifting mechanism 15 includes an actuator 42, a transmission shaft 43, and a link mechanism 44. The actuator 42 shifts the shift shaft 41 along the propeller shaft axial direction via the transmission shaft 43 and the link mechanism 44. For example, the actuator 42 may be an electrically operated cylinder. The actuator 42 is attached to the lower casing **3*b*. The output shaft of the actuator 42 is connected to the transmission shaft 43. The actuator 42 shifts the transmission shaft 43 along the axial direction of the transmission shaft 43. In other words, the actuator 42 shifts the transmission shaft 43** in the vertical direction.

The transmission shaft 43 is disposed within the lower casing **3*b* so as to extend in the vertical direction. The transmission shaft 43 transmits the operation of the actuator 42 to the shift shaft 41. The link mechanism 44 converts and transmits the movement of the transmission shaft 43 in the vertical direction into movement of the shift shaft 41** along the propeller shaft axial direction.

Figure 4:
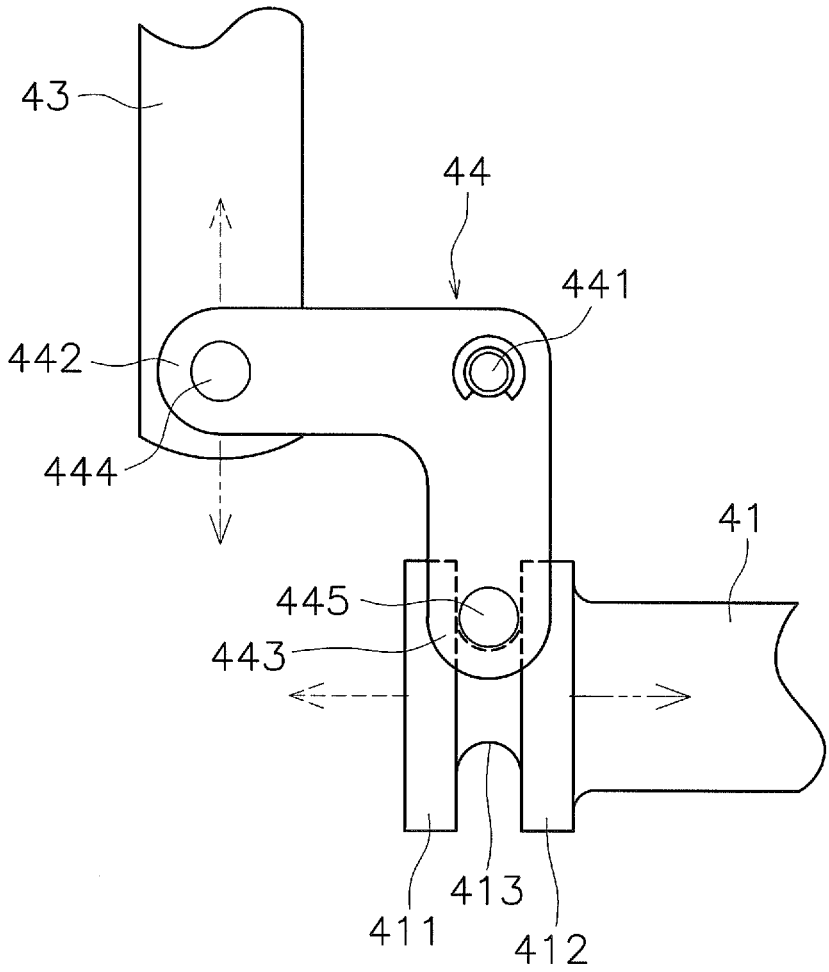
FIG. 4 is an enlarged view of a link mechanism.

FIG. 4 is an enlarged view of the link mechanism 44. As seen from the side, the link mechanism 44 preferably has a bent shape. The link mechanism 44 includes a rotation support portion 441. The rotation support portion 441 is connected to the bent portion of the link mechanism 44. The rotation support portion 441 is rotatably supported by the lower casing 3*b*. The link mechanism 44 is provided so as to rotate about the rotation support portion 441 as a center. The link mechanism 44 includes a first end portion 442 and a second end portion 443. The first end portion 442 is rotatably connected to the transmission shaft 43. The first end portion 442 is connected to the transmission shaft 43 via a first pin member 444. The second end portion 443 is rotatably connected to the shift shaft 41. In detail, the second end portion 443 is connected to the shift shaft 41 via a second pin member 445.

In more detail, the end portion of the shift shaft 41 includes a first flange portion 411, a second flange portion 412, and an engaging groove portion 413. The first flange portion 411, the engaging groove portion 413, and the second flange portion 412 are arranged in that sequence along the axial direction of the shift shaft 41. The engaging groove portion 413 is positioned between the first flange portion 411 and the second flange portion 412. The second pin member 445 is disposed within the engaging groove portion 413.

When the transmission shaft 43 shifts upward, the link mechanism 44 rotates in the clockwise direction in FIG. 4 about the rotation support portion 441 as a center. Due to this configuration, the first flange portion 411 is pushed by the second pin member 445, and the shift shaft 41 is shifted leftward in FIG. 4 (hereinafter this will be termed the "forward shifting direction"). Conversely, when the transmission shaft 43 shifts downward, the link mechanism 44 rotates in the counterclockwise direction in FIG. 4 about the rotation support portion 441 as a center. Due to this configuration, the second flange portion 412 is pushed by the second pin member 445, and the shift shaft 41 is shifted rightward in FIG. 4 (hereinafter this will be termed the "reverse shifting direction").

The shift shaft 41 transmits the operation of the actuator 42 to the dog clutch 26, the forward clutch 31, and the reverse clutch 32. As shown in FIG. 2, the shift shaft 41 is linked to the shaft portion 261 of the dog clutch 26. The dog clutch 26 is shifted along the propeller shaft axial direction by the shift shaft 41 shifting along the propeller shaft axial direction. Due to this configuration, the connection/disconnection of the dog clutch 26 is changed. Moreover, the connection/disconnection of the forward clutch 31 is changed by the shift shaft 41 shifting along the propeller shaft axial direction. Yet further, the connection/disconnection of the reverse clutch 32 is changed by the shift shaft 41 shifting along the propeller shaft axial direction.

In detail, the connection changeover mechanism 28 includes a first detent mechanism 45 and a second detent mechanism 46. The first detent mechanism 45 and the second detent mechanism 46 are both attached to the shift shaft 41. The first detent mechanism 45 is disposed within the first clutch piston 35. As shown in FIG. 3, the first detent mechanism 45 includes a detent main body portion 51, a first engagement member 52, a first elastic member 53, a second engagement member 54, and a second elastic member 55.

The detent main body portion 51 preferably has a tubular shape. The detent main body portion 51 is arranged so that the axial line of the detent main body portion 51 is orthogonal or substantially orthogonal to the direction of the axial line of the shift shaft 41. The shift shaft 41 includes a hole 414 that pierces through the shift shaft 41 in the direction orthogonal or substantially orthogonal to the direction of the axial line of the shift shaft 41. The detent main body portion 51 is inserted into the hole 414 of the shift shaft 41. Both ends of the detent main body portion 51 project from the outer circumferential surface of the shift shaft 41 in diametrically opposite radial directions. The detent main body portion 51 includes a first reception portion 511 and a second reception portion 512. The first reception portion 511 is a hole that extends along the direction of the axial line of the detent main body portion 51. The first reception portion 511 opens at one end of the detent main body portion 51. The second reception portion 512 is a hole that extends along the direction of the axial line of the detent main body portion 51. The second reception portion 512 opens at the other end of the detent main body portion 51.

The first elastic member 53 is disposed within the first reception portion 511. The first elastic member 53 pushes the first engagement member 52 towards the inner circumferential surface of the first clutch piston 35. The second elastic member 55 is disposed within the second reception portion 512. The second elastic member pushes the second engagement member 54 towards the inner circumferential surface of the second clutch piston 35 on the other side thereof. The first elastic member 53 and the second elastic member 55 may, for example, be compression coil springs. However, the first elastic member 53 and the second elastic member 55 are not limited to being compression coil springs; they may be components of any type that generate elastic forces to push the first engagement member 52 and second engagement member 54 appropriately.

The first engagement member 52 and the second engagement member 54 are preferably spherical members. A portion of the first engagement member 52 is disposed within the first reception portion 511. Another portion of the first engagement member 52 projects from the detent main body portion 51, and contacts against the inner circumferential surface of the first clutch piston 35. Similarly, a portion of the second engagement member 54 is disposed within the second reception portion 512. Another portion of the second engagement member 54 projects from the detent main body portion 51, and contacts against the inner circumferential surface of the first clutch piston 35 on the other side thereof.

The inner circumferential surface of the first clutch piston 35 includes a first flat surface 352, a first step portion 353, and a second flat surface 354. The first flat surface 352 is positioned further outward in the radial direction of the first clutch piston 35 than the second flat surface 354. The first step portion 353 is positioned between the first flat surface 352 and the second flat surface 354.

On its other side, the inner circumferential surface of the first clutch piston 35 includes a third flat surface 355, a second step portion 356, and a fourth flat surface 357. The third flat surface 355 is positioned further outward in the radial direction of the first clutch piston 35 than the fourth flat surface 357. The second step portion 356 is positioned between the third flat surface 355 and the fourth flat surface 357.

In the first detent mechanism 45, when the shift shaft 41 shifts in the forward shifting direction, the first engagement member 52 is engaged to the first step portion 353, and the second engagement member 54 is engaged to the second step portion 356. Due to this configuration, the first detent mechanism 45 shifts the first clutch piston 35 in the forward shifting direction.

The second detent mechanism 46 is disposed within the second clutch piston 39. The second detent mechanism 46 includes a detent main body portion 61, a first engagement member 62, a first elastic member 63, a second engagement member 64, and a second elastic member 65. The detent main body portion 61, the first engagement member 62, the first elastic member 63, the second engagement member 64, and the second elastic member 65 of the second detent mechanism 46 preferably are respectively identical to the detent main body portion 51, the first engagement member 52, the first elastic member 53, the second engagement member 54, and the second elastic member 55 of the first detent mechanism 45.

The inner circumferential surface of the second clutch piston 39 includes a first flat surface 392, a first step portion 393, and a second flat surface 394. The first flat surface 392, the first step portion 393, and the second flat surface 394 of the second clutch piston 39 preferably are respectively identical to the first flat surface 352, the first step portion 353, and the second flat surface 354 of the first clutch piston 35. On its other side, the inner circumferential surface of the second clutch piston 39 includes a third flat surface 395, a second step portion 396, and a fourth flat surface 397. The third flat surface 395, the second step portion 396, and the fourth flat surface 397 of the second clutch piston 39 preferably are respectively identical to the third flat surface 355, the second step portion 356, and the fourth flat surface 357 of the first clutch piston 35.

In the second detent mechanism 46, when the shift shaft 41 shifts in the reverse shifting direction, the first engagement member 62 is engaged to the first step portion 393, and the second engagement member 64 is engaged to the second step portion 396. Due to this configuration, the second detent mechanism 46 shifts the second clutch piston 39 in the reverse shifting direction.

Next, the operation for shifting the dog clutch 26 and the friction clutches 31 and 32 by the shifting mechanism 15 will be explained. FIG. 2 described above shows the shifting mechanism 15 in a state in which the shift shaft 41 is positioned in its neutral position (hereinafter this will be termed the "neutral state"). By the shift shaft 41 shifting from its neutral position in the forward shifting direction, it shifts from its neutral position through a forward intermediate position to a forward connection position.

Figure 5:
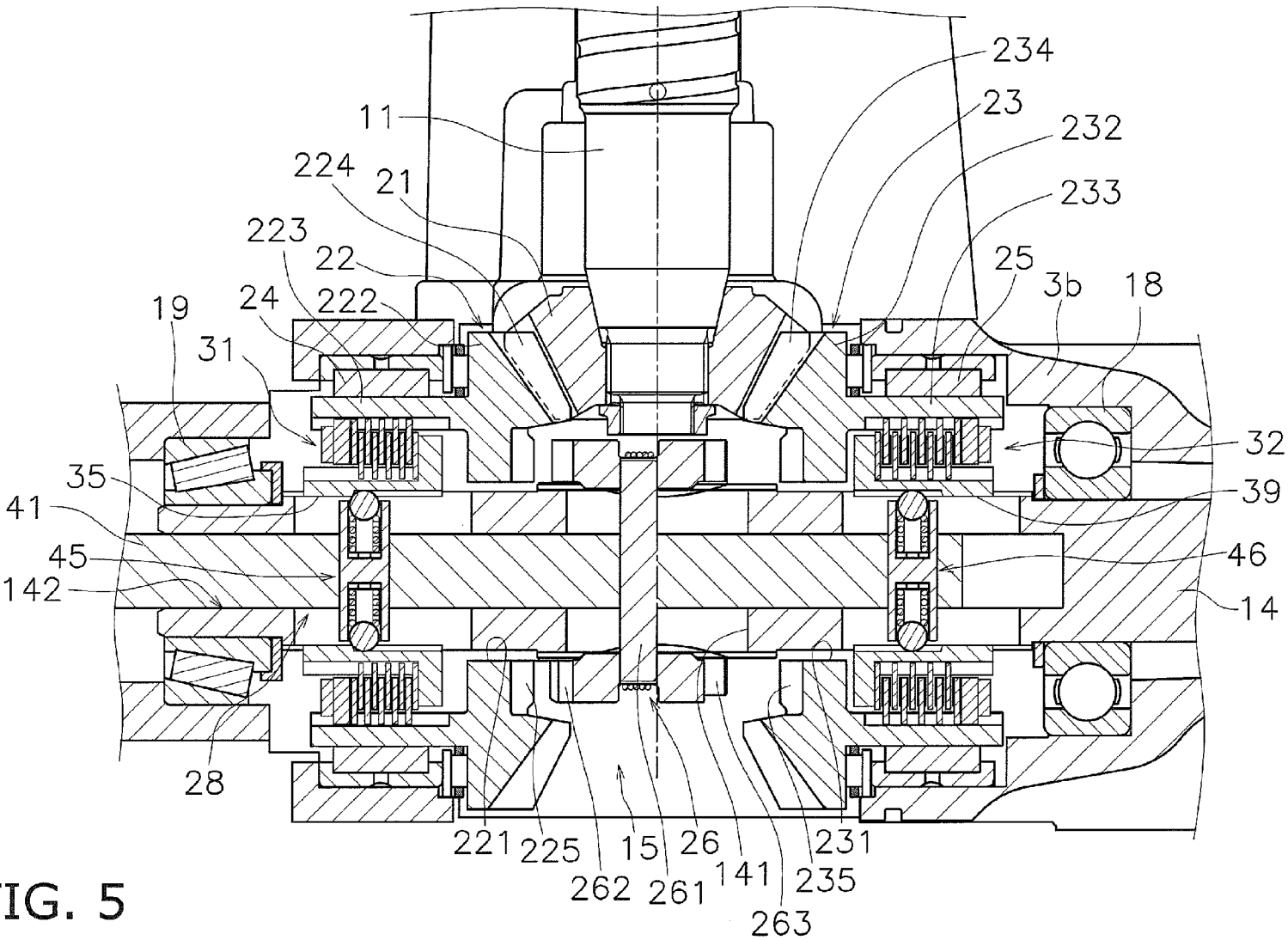
FIG. 5 is a sectional view showing the shifting mechanism in a state in which the shift shaft is positioned at a forward intermediate position.
Figure 6:
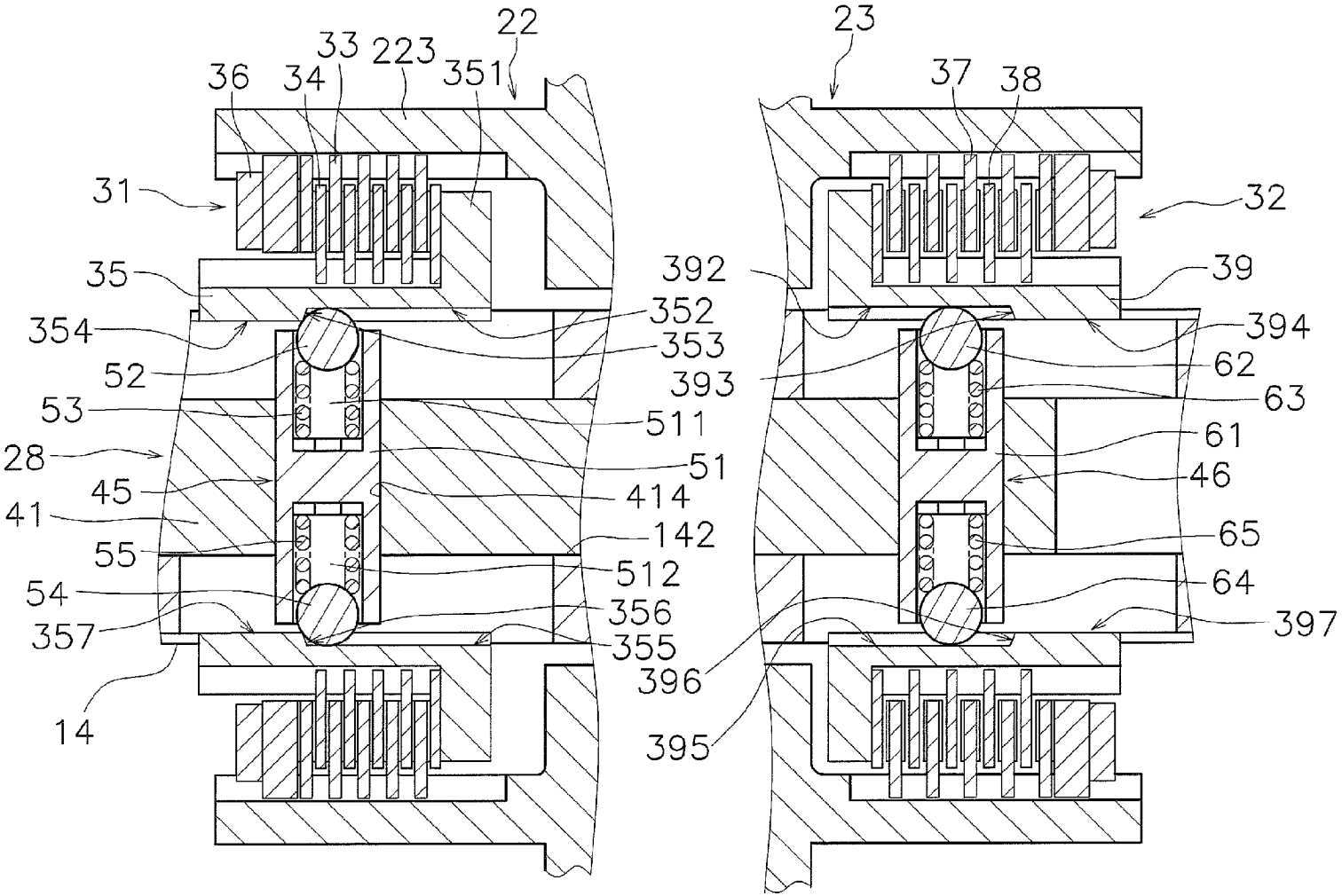
FIG. 6 is an enlarged view of the shifting mechanism in the state in which the shift shaft is positioned at the forward intermediate position.
Figure 7:
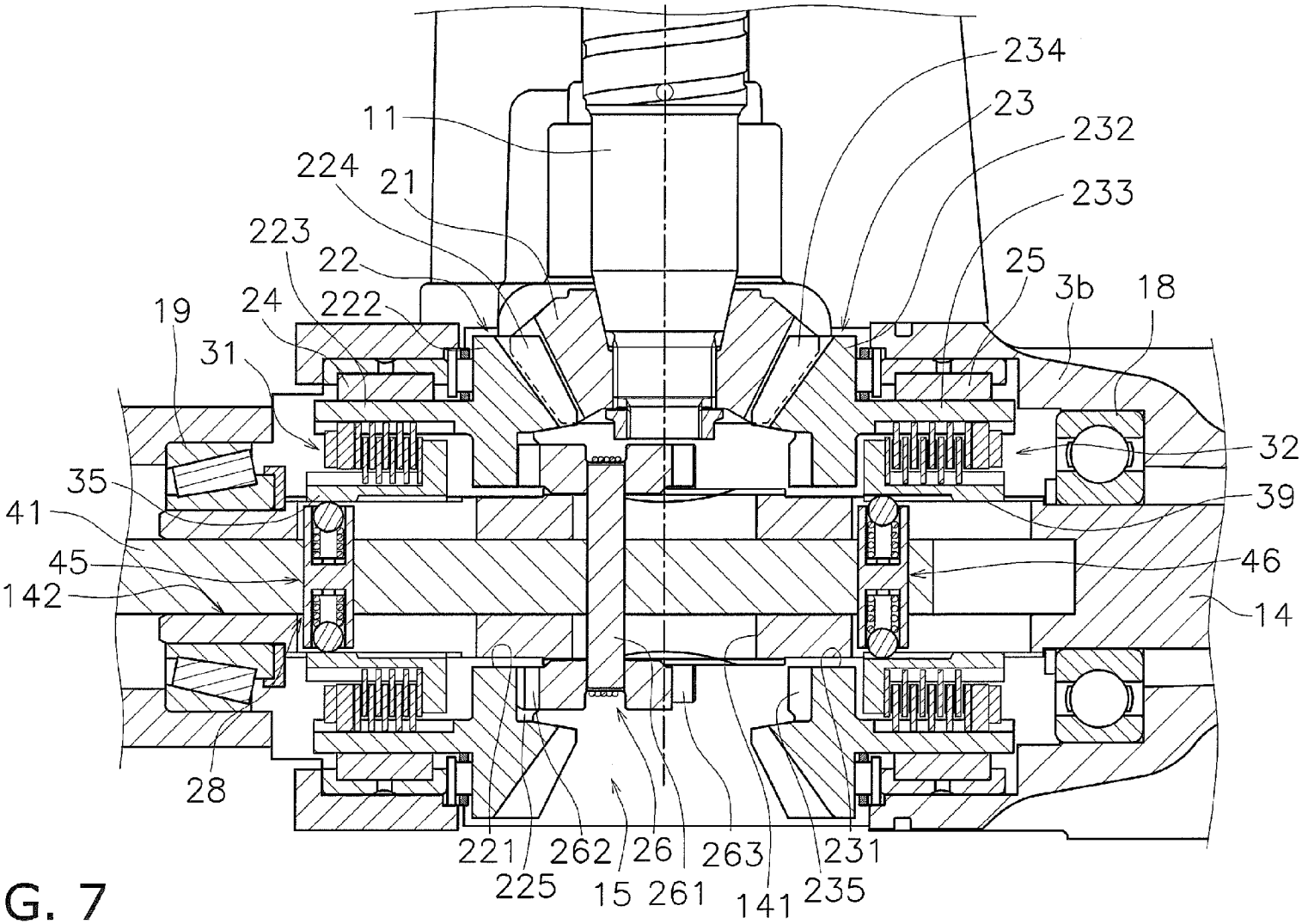
FIG. 7 is a sectional view showing the shifting mechanism in a state in which the shift shaft is positioned at a forward connection position.
Figure 8:
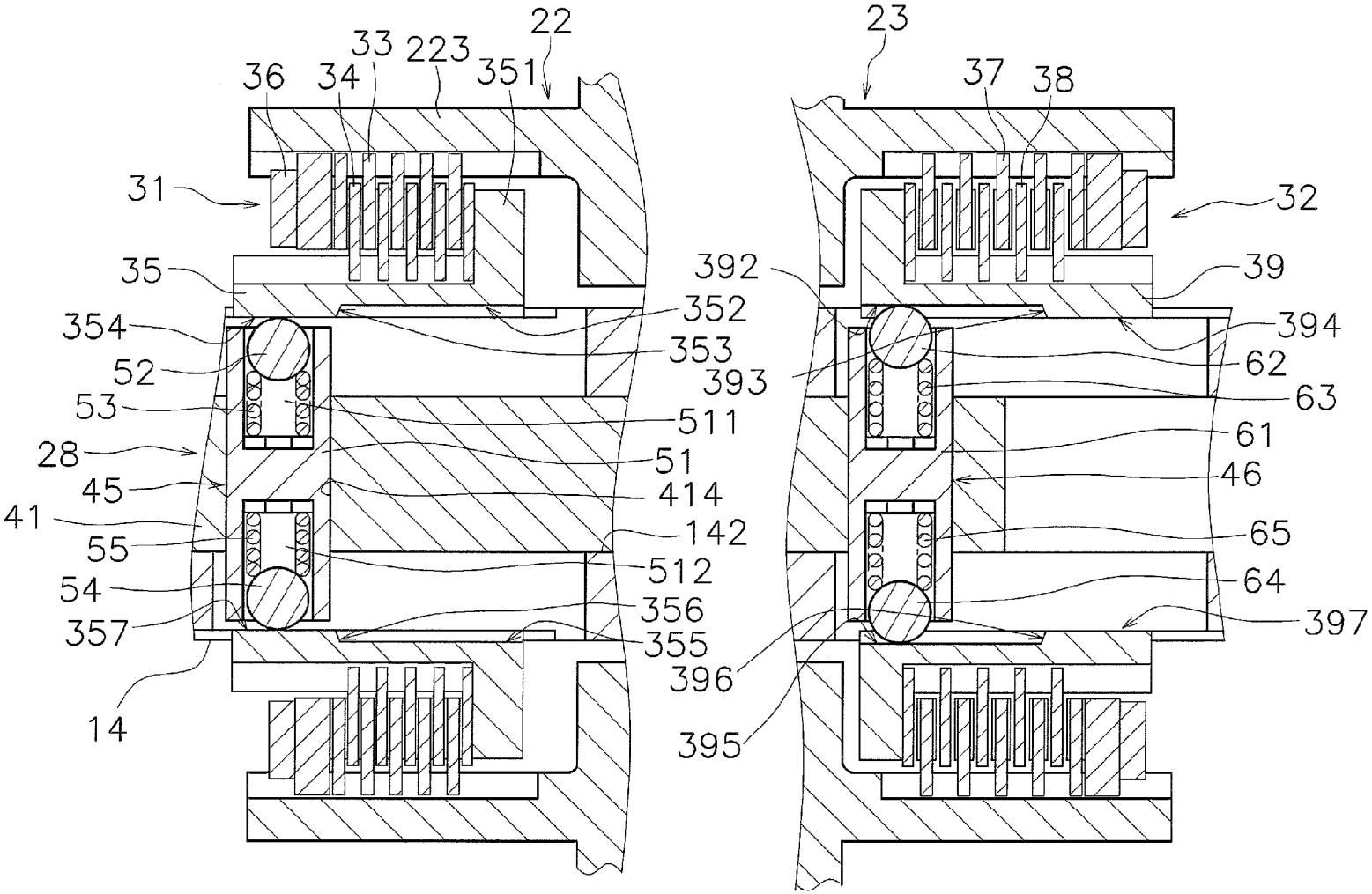
FIG. 8 is an enlarged view of the shifting mechanism in the state in which the shift shaft is positioned at the forward connection position.

FIG. 5 shows the shifting mechanism 15 in a state in which the shift shaft 41 is positioned at the forward intermediate position (hereinafter this will be termed the "forward synchronizing state"). FIG. 6 is an enlarged view of the shifting mechanism 15 in the forward synchronizing state. Moreover, FIG. 7 shows the shifting mechanism 15 in a state in which the shift shaft 41 is positioned at the forward connection position (hereinafter this will be termed the "forward connected state"). Yet further, FIG. 8 is an enlarged view of the shifting mechanism 15 in the forward connected state. The forward intermediate position shown in FIG. 5 is a position between the neutral position shown in FIG. 2 and the forward connection position shown in FIG. 7.

As shown in FIG. 2, in the neutral state, the shaft portion 261 of the dog clutch 26 is positioned directly under the axial line of the drive shaft 11. The forward dog portion 262 of the dog clutch 26 is separated from the dog portion 225 of the forward gear 22. Moreover, the reverse dog portion 263 of the dog clutch 26 is separated from the dog portion 235 of the reverse gear 23. Accordingly, the dog clutch 26 is disconnected both from the forward gear 22 and from the reverse gear 23.

Furthermore, as shown in FIG. 3, in the neutral state, the first detent mechanism 45 releases engagement with the first clutch piston 35. In other words, the first engagement member 52 does not press against the first step portion 353, and also the second engagement member 54 does not press against the second step portion 356. Due to this configuration, the inner second clutch plates 34 and the outer second clutch plates 33 of the forward clutch 31 are disconnected from one another. Due to this configuration, the forward clutch 31 is in the disconnected state. It should be understood that it would be acceptable, in the neutral state, for the first engagement member 52 of the first detent mechanism 45 to contact against the first step portion 353. Moreover, it would also be acceptable, in the neutral state, for the second engagement member 54 of the first detent mechanism 45 to contact against the second step portion 356.

In a similar manner to the case with the first detent mechanism 45, in the neutral state, the second detent mechanism 46 releases engagement with the second clutch piston 39. In other words, the first engagement member 62 of the second detent mechanism 46 does not press against the first step portion 393. Moreover, the second engagement member 64 of the second detent mechanism 46 does not press against the second step portion 396. Due to this configuration, the reverse clutch 32 is in the disconnected state.

It should be understood that, in the neutral state, the first engagement member 52 of the first detent mechanism 45 contacts against the first flat surface 352, and also the second engagement member 54 contacts against the third flat surface 355. Moreover, in the neutral state, the first engagement member 62 of the second detent mechanism 46 contacts against the first flat surface 392, and also the second engagement member 64 contacts against the third flat surface 395.

As described above, in the neutral state, the connection changeover mechanism 28 puts the dog clutch 26 and the forward gear 22 into the disconnected state, and also puts the forward clutch 31 into the disconnected state. Moreover, in the neutral state, the connection changeover mechanism 28 puts the dog clutch 26 and the reverse gear 23 into the disconnected state, and also puts the reverse clutch 32 into the disconnected state. Accordingly, in the neutral state, the rotation of the drive shaft 11 is not transmitted to the propeller shaft 14.

When the shift shaft 41 shifts from the neutral position in the forward shifting direction, the first engagement member 52 of the first detent mechanism 45 pushes the first step portion 353 in the forward shifting direction, and the second engagement member 54 pushes the second step portion 356 in the forward shifting direction. Due to this configuration, the first clutch piston 35 shifts in the forward shifting direction, and presses upon the inner first clutch plates 34 and the outer first clutch plates 33 of the forward clutch 31. As a result, contact between the inner first clutch plates 34 and the outer first clutch plates 33 of the forward clutch 31 is started, and the shifting mechanism 15 transitions into the forward synchronizing state shown in FIG. 5.

In the forward synchronizing state, the shaft portion 261 of the dog clutch 26 is shifted in the forward shifting direction from the position directly under the axial line of the drive shaft 11. However, the forward dog portion 262 of the dog clutch 26 is still separated from the dog portion 225 of the forward gear 22. Moreover, the reverse dog portion 263 of the dog clutch 26 is separated from the dog portion 235 of the reverse gear 22. Accordingly, the dog clutch 26 is disconnected both from the forward gear 22 and from the reverse gear 23.

Moreover, as shown in FIG. 6, in the forward synchronizing state, the first detent mechanism 45 is engaged to the first clutch piston 35. In other words, the first engagement member 52 is contacted against the first step portion 353, and the second engagement member 54 is contacted against the second step portion 356. The first engagement member 52 presses against the first step portion 353 and the second engagement member 54 presses against the second step portion 356, so as to make the inner first clutch plates 34 and the outer first clutch plates 33 of the forward clutch 31 contact one another. Due to this configuration, the forward clutch 31 is put into the connected state. It should be understood that, the more the shift shaft 41 is shifted in the forward shifting direction, the stronger the pressure becomes with which the inner first clutch plates 34 and the outer first clutch plates 33 of the forward clutch 31 are squeezed together.

Furthermore, in the forward synchronizing state, engagement of the second detent mechanism 46 to the second clutch piston 39 is released. In other words, the first engagement member 62 of the second detent mechanism 46 is separated from the first step portion 393, and the second engagement member 64 is separated from the second step portion 396. Accordingly, the first engagement member 62 does not push against the first step portion 393, and the second engagement member 64 does not push against the second step portion 396. Due to this configuration, the reverse clutch 32 remains in the disconnected state.

Thus, as described above, in the forward synchronizing state, the connection changeover mechanism 28, along with leaving the dog clutch 26 and the forward gear 22 in the disconnected state, also puts the forward clutch 31 into the connected state. Moreover, in the forward synchronizing state, the connection changeover mechanism 28, along with leaving the dog clutch 26 and the reverse gear 23 in the disconnected state, also leaves the reverse clutch in the disconnected state. Accordingly, in the forward synchronizing state, the rotation of the drive shaft 11 is transmitted to the propeller shaft 14 via the forward clutch 31. In the forward synchronizing state, the inner first clutch plates 34 and the outer first clutch plates 33 of the forward clutch 31 transmit the rotation of the drive shaft 11 to the propeller shaft 14 while mutually slipping past one another to a certain extent. Due to this configuration, the forward gear 22 and the dog clutch 26 are mutually synchronized by the dog clutch 26 rotating along with the propeller shaft 14.

When the shift shaft 41 is driven further in the forward shifting direction from its forward intermediate position, and the force exerted by the first detent mechanism 45 upon the first clutch piston 35 becomes greater than a predetermined value, the first engagement member 52 shifts radially inward of the shift shaft 41 against the resistance of the elastic force of the first elastic member 53 which is overcome. Moreover, the second engagement member 54 shifts radially inward of the shift shaft 41 against the resistance of the elastic force of the second elastic member 55 which is overcome. Due to this configuration, the first engagement member 52 shifts in the forward shifting direction by riding over the first step portion 353. Moreover, the second engagement member 54 shifts in the forward shifting direction by riding over the second step portion 356. Due to this configuration, the engagement of the first detent mechanism 45 to the first clutch piston 35 is released. As a result, the shift shaft 41 shifts from the forward intermediate position to the forward connection position, and the shifting mechanism 15 transitions into the forward connected state shown in FIG. 7.

In the forward connected state, the shaft portion 261 of the dog clutch 26 shifts further in the forward direction from its position directly below the axial line of the drive shaft. The dog portion 262 of the dog clutch 26 is also meshed with the dog portion 225 of the forward gear 22. Moreover, the reverse dog portion 263 of the dog clutch 26 is disengaged from the dog portion 235 of the reverse gear 23. Accordingly, the dog clutch 26 is connected to the forward gear 22, and is disconnected from the reverse gear 23.

Moreover, as shown in FIG. 8, in the forward connected state, the first detent mechanism 45 releases engagement with the first clutch piston 35. In other words, the first engagement member 52 rides over the first step portion 353, and contacts the second flat portion 354. Moreover, the second engagement member 54 rides over the second step portion 356, and contacts the fourth flat portion 357. Due to this configuration, the first engagement member 52 and the second engagement member 54 do not push the first clutch piston 35 along the propeller shaft axial direction, so that the inner first clutch plates 34 and the outer first clutch plates 33 of the forward clutch 31 are mutually disengaged. Due to this configuration, the forward clutch 31 is put into the disconnected state.

Furthermore, in the forward connected state, the second detent mechanism 46 is disengaged from the second clutch piston 39. In other words, the first engagement member 62 of the second detent mechanism 46 is removed from the first step portion 393, and also the second engagement member 64 is removed from the second step portion 396. Accordingly, the first engagement member 62 does not push upon the first step portion 393, and the second engagement member 64 does not push upon the second step portion 396. Due to this configuration, the reverse clutch 32 remains in the disconnected state.

As has been explained above, in the forward connected state, the connection changeover mechanism 28 puts the dog clutch 26 and the forward gear 22 into the connected state, and also puts the forward clutch 31 into the disconnected state. Moreover, in the forward connected state, the connection changeover mechanism 28 puts the dog clutch 26 and the reverse gear 23 into the disconnected state, and also puts the reverse clutch 32 into the disconnected state. Accordingly, in the forward connected state, the rotation of the drive shaft 11 is transmitted to the propeller shaft 14 via the forward gear 22 and the dog clutch 26.

Figure 9:
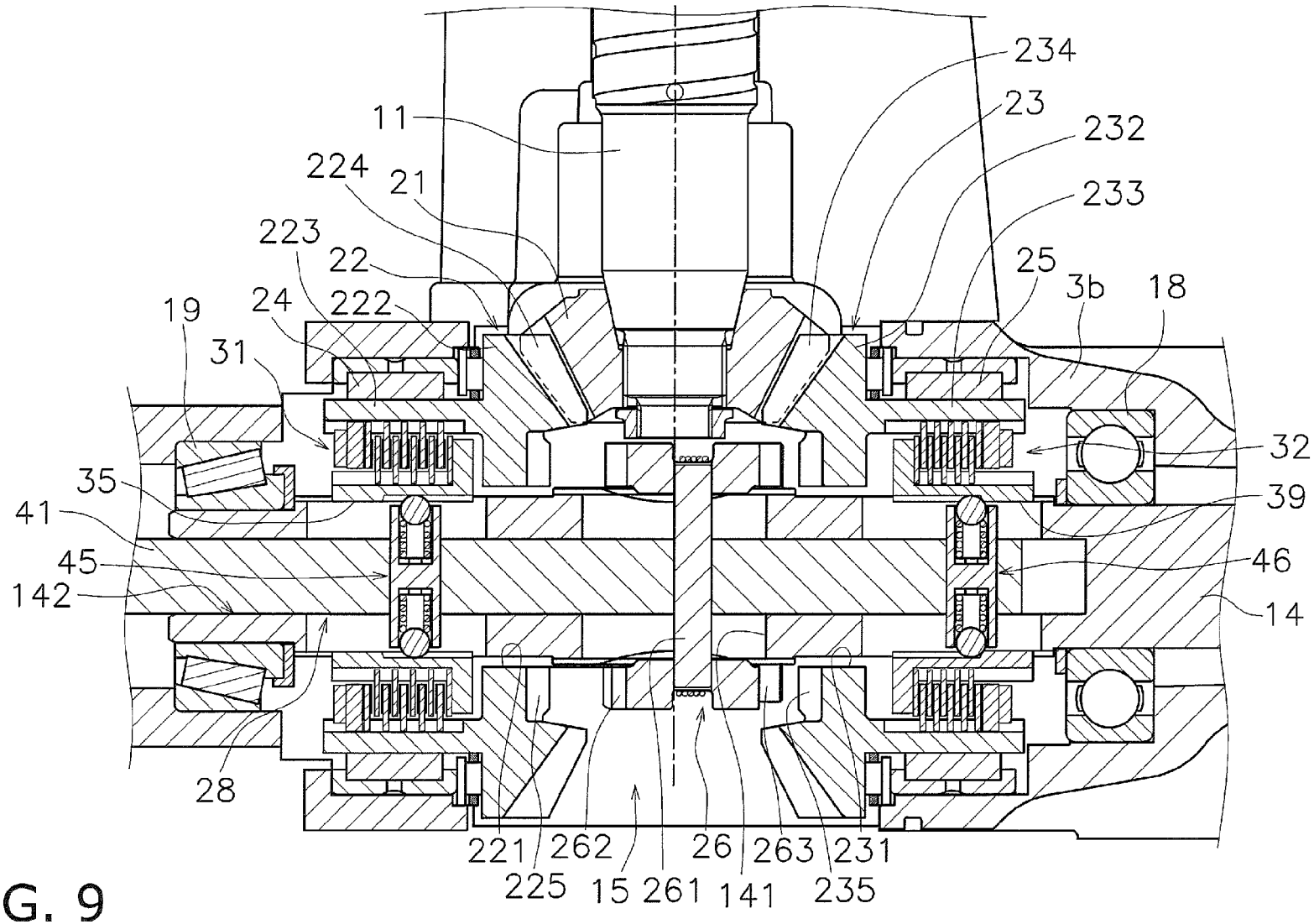
FIG. 9 is a sectional view showing the shifting mechanism in a state in which the shift shaft is positioned at a reverse intermediate position.
Figure 10:
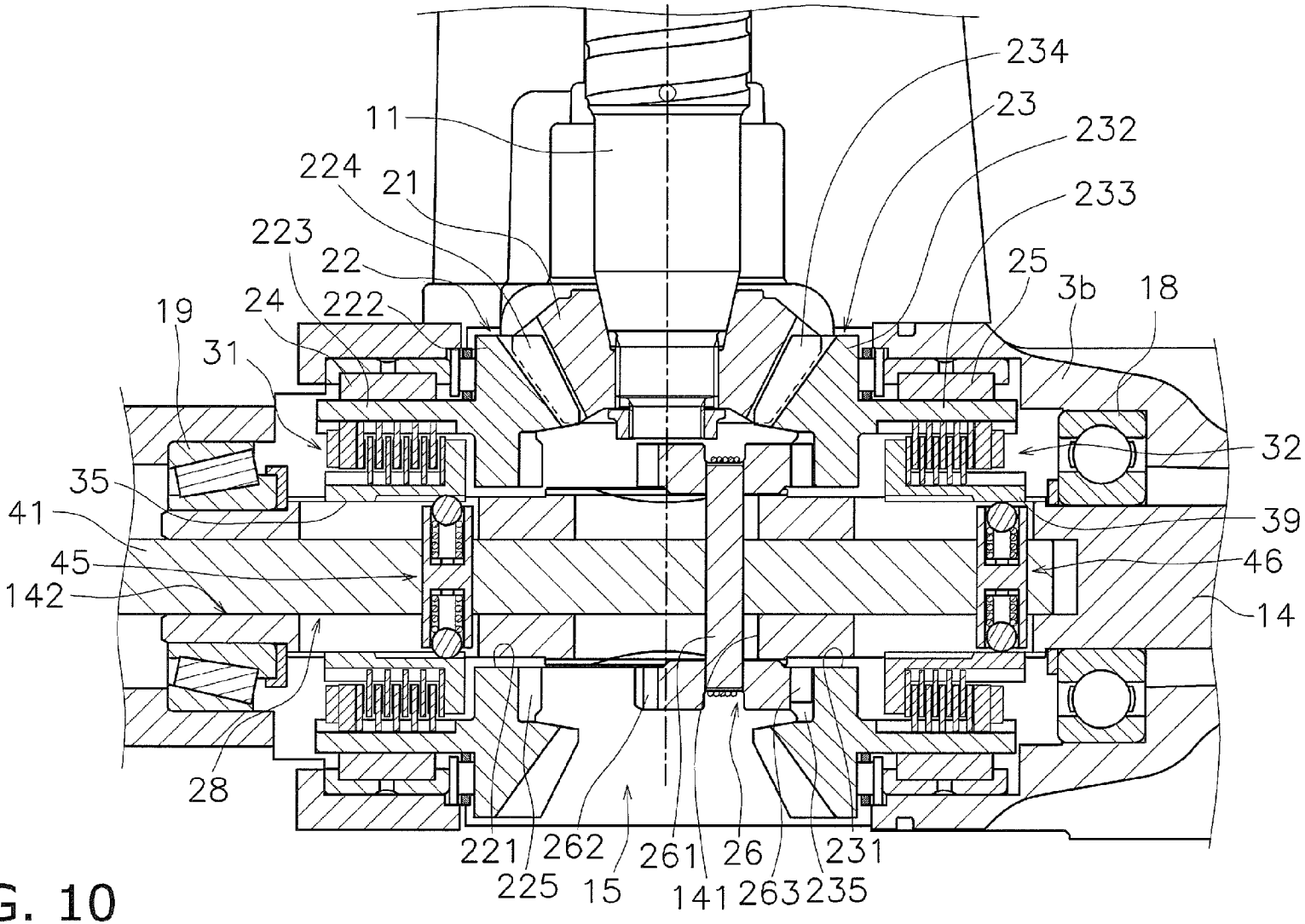
FIG. 10 is a sectional view showing the shifting mechanism in a state in which the shift shaft is positioned at a reverse connection position.

Yet further, by the shift shaft 41 shifting from its neutral position in the reverse shifting direction, which is opposite to the forward shifting direction, the system shifts from the neutral position to a reverse connection position via a reverse intermediate position. The reverse intermediate position is positioned between the neutral position and the reverse connection position. FIG. 9 shows the shifting mechanism 15 in a state in which the shift shaft 41 is positioned at its reverse intermediate position (hereinafter this will be termed the "reverse synchronizing state"). And FIG. 10 shows the shifting mechanism 15 in a state in which the shift shaft 41 is positioned at its reverse connection position (hereinafter this will be termed the "reverse connected state").

As shown in FIG. 9, in the reverse synchronizing state, in a similar manner to the case with the forward synchronizing state, the dog clutch 26 is disconnected both from the forward gear 22 and from the reverse gear 23. Moreover, in the reverse synchronizing state, the second detent mechanism is engaged to the second clutch piston 39. Due to this configuration, the reverse clutch 32 is put into the connected state. Moreover, in the reverse synchronizing state, the first detent mechanism 45 is disengaged from the first clutch piston 35. Due to this configuration, the forward clutch 31 is maintained in the disconnected state.

As described above, in the reverse synchronizing state, the connection changeover mechanism 28 puts the dog clutch 26 and the reverse gear 23 into the disconnected state, and puts the reverse clutch 32 into the connected state. Moreover, in the reverse synchronizing state, the connection changeover mechanism 28 puts the dog clutch 26 and the forward gear 22 into the disconnected state, and also puts the forward clutch 31 into the disconnected state. Accordingly, in the reverse synchronizing state, the rotation of the drive shaft is transmitted to the propeller shaft 14 via the reverse clutch 32. Due to this configuration, the reverse gear 23 and the dog clutch 26 are synchronized by the dog clutch 26 rotating along with the propeller shaft 14.

When the shift shaft 41 is further driven from the reverse intermediate position in the reverse shifting direction, and the load exerted from the second detent mechanism 46 upon the second clutch piston 39 becomes greater than a predetermined value, the first engagement member 62 of the second detent mechanism 46 shifts radially inward of the shift shaft 41 against the resistance of the elastic force of the first elastic member 63 which is overcome. Moreover, the second engagement member 64 shifts radially inward of the shift shaft 41 against the resistance of the elastic force of the second elastic member 65 which is overcome. Due to this configuration, the first engagement member 62 rides over the first step portion 393 and shifts in the reverse shifting direction. Moreover, the second engagement member 64 rides over the second step portion 396 and shifts in the reverse shifting direction. As a result, the shifting mechanism 15 transitions into the reverse connected state shown in FIG. 10.

In the reverse connected state, the reverse dog portion 263 of the dog clutch 26 is meshed with the dog portion 235 of the reverse gear 23. Moreover, the forward dog portion 262 of the dog clutch 26 is removed from the dog portion 225 of the forward gear 22. Accordingly, the dog clutch 26 is connected to the reverse gear 23 and is disconnected from the forward gear 22.

Furthermore, in the reverse connected state, the second detent mechanism 46 is disengaged from the second clutch piston 39. Due to this configuration, the reverse clutch 32 is put into the disconnected state. Moreover, in the reverse connected state, the first detent mechanism 45 is disconnected from the first clutch piston 35. Due to this configuration, the forward clutch 31 remains in the disconnected state.

As described above, in the reverse connected state, the connection changeover mechanism 28 puts the dog clutch 26 and the reverse gear 23 into the connected state, and puts the reverse clutch 32 into the disconnected state. Moreover, in the reverse connected state, the connection changeover mechanism 28 puts the dog clutch 26 and the forward gear 22 into the disconnected state, and also puts the forward clutch 31 into the disconnected state. Accordingly, in the reverse connected state, the rotation of the drive shaft 11 is transmitted to the propeller shaft 14 via the reverse gear 23 and the dog clutch 26.

Figure 11:
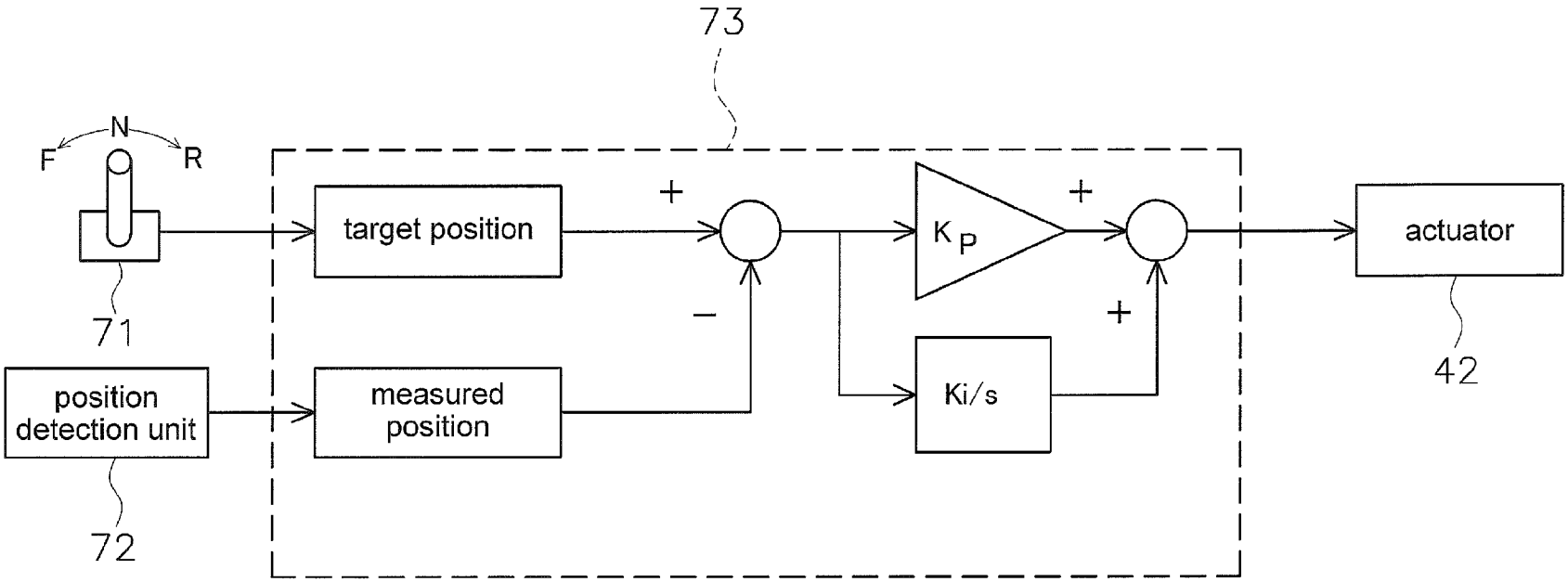
FIG. 11 is a block diagram of a control system of the outboard motor.

Next, the control system of the outboard motor 1 will be explained. FIG. 11 is a block diagram showing the control system of the outboard motor 1. The outboard motor 1 includes a shift operating member 71, a position detection unit 72, and a control unit 73. The shift operating member 71 is configured to be operated to a neutral operating position "N", a forward operating position "F", and a reverse operating position "R". A detection signal specifying the operating position of the shift operating member 71 is inputted to the control unit 73.

The position detection unit 72 continuously detects the position of the shift shaft 41. A detection signal that specifies the operating position of the shift shaft 41 is inputted to the control unit 73. For example, the position detection unit 72 may detect the position in the vertical direction of the transmission shaft 43 by detecting the rotational angle of the axis of a motor within the actuator 42. The control unit 73 is configured or programmed to determine the front-back position of the shift shaft 41 from the value of the position in the vertical direction of the transmission shaft 43.

The control unit 73 includes a calculation device such as a CPU or the like, and storage devices such as RAM and ROM and so on. The control unit 73 is configured or programmed to perform electronic control of the actuator 42 according to the operating position of the shift operating member 71 and the position of the shift shaft 41. The control unit 73 inputs a command signal to the actuator 42. The drive force of the actuator 42 changes according to this command signal. The control unit 73 is configured or programmed to execute synchronization control before the shifting stage in which the dog clutch 26 and the forward gear 22 or the reverse gear 23 mesh together. In the following, this synchronization control will be explained for the forward shifting case in which the dog clutch 26 and the forward gear 22 mesh together.

Figure 12:
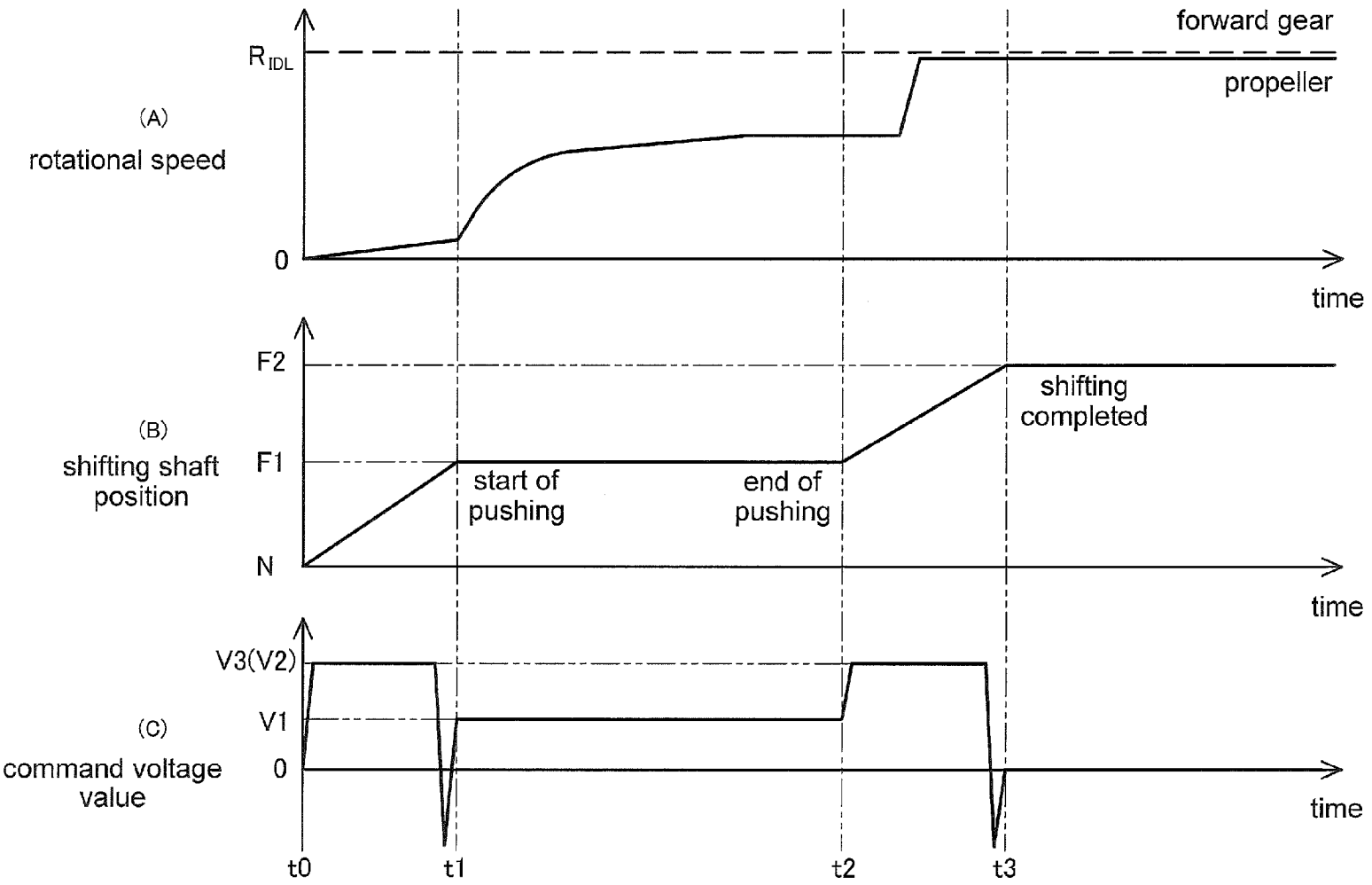
FIG. 12 is a timing chart showing synchronization control during forward shifting.

During forward shifting, the control unit 73 is configured or programmed to control the actuator 42, and to shift the shaft 41 from the neutral position to the forward intermediate position. Due to this configuration, the inner first clutch plates 34 and the outer first clutch plates 33 of the forward clutch 31 are contacted together, and the rotational speed of the forward gear 22 and the rotational speed of the dog clutch 26 are synchronized together. FIG. 12 is a timing chart showing the synchronization control during forward shifting.

The broken line in FIG. 12(A) shows the change of the rotational speed of the forward gear 22. It will be assumed that the rotational speed of the forward gear 22 is constant at an idling rotational speed $R_{IDL}$. The solid line in FIG. 12(A) shows the change of the rotational speed of the propeller 12. FIG. 12(B) shows the change of the position of the shift shaft 41. FIG. 12(C) shows the change of the command voltage value sent to the actuator 42.

At the time point t0, the shift operating member 71 is positioned at the neutral operating position "N". Accordingly, as shown in FIG. 12(C), the command voltage value to the actuator 42 is 0, and the actuator 42 is not being driven. Moreover, as shown in FIG. 12(B), the shift shaft 41 is positioned at the neutral position "N". Furthermore, as shown in FIG. 12(A), the rotational speed of the propeller is 0.

When the shift operating member 71 is operated from the neutral operating position "N" to the forward operating position "F", the control unit 73 controls the actuator 42 so that the shift shaft 41 shifts from the neutral position "N" to a second target position "F2" via a first target position "F1". In the synchronization control for forward shifting, the first target position "F1" is the forward intermediate position described above. The second target position "F2" is the forward connection position described above. The control unit 73 controls the actuator 42 by feedback control on the basis of the detection signal from the position detection unit 72, so that the shift shaft 41 shifts to the first target position "F1" and then to the second target position "F2".

In detail, first, between the time point t0 and the time point t1, the control unit 73 inputs a command signal having a third command value V3 to the actuator 42. Due to this, the shift shaft 41 shifts from its neutral position "N" toward the first target position "F1". The third command value V3 is a fixed value. In the present preferred embodiment, the third command value V3 is the maximum voltage value for the actuator 42. However, the third command value V3 could also be less than this maximum voltage value. Moreover, the third command value is not limited to being a fixed value; it could also be variable.

At the time point t1, the connection of the forward clutch 31 is started. In other words, the contacting between the inner first clutch plates 34 and the outer first clutch plates 33 of the forward clutch 31 is started at the time point t1. It should be understood that, directly before the time point t1, the control unit 73 decreases the command value for the actuator 42. Due to this configuration, overshooting of the first target position "F1" is prevented by decelerating the shift shaft 41.

From the time point t1 until the time point t2, the control unit 73 executes synchronization control so as to position the shift shaft 41 at the first target position "F1" by inputting a command signal having a first command value V1 to the actuator 42. The first command value V1 is smaller than the third command value V3. The first command value V1 is a fixed value. However, the first command value V1 is not limited to being a fixed value; it could also be variable.

In the synchronization control, the control unit 73 holds the command value to the actuator 42 at the first command value V1 for a predetermined time period. Due to this, the contacting state between the inner first clutch plates 34 and the outer first clutch plates 33 of the forward clutch 31 is maintained. In other words, during the predetermined time period, the frictional force between the inner first clutch plates 34 and the outer first clutch plates 33 of the forward clutch 31 is kept constant.

As shown in FIG. 12(A), between the time point t1 and the time point t2, due to the above synchronization control, the rotational speed of the propeller gradually increases. Due to this, the difference between the rotational speed of the forward gear 22 and the rotational speed of the propeller 12 decreases.

It should be understood that the predetermined time period is the time period until the difference between the rotational speed of the propeller 12 and the rotational speed of the forward gear 22 reaches an equilibrium state. In other words, the predetermined time period is the time period until the difference between the rotational speed of the propeller shaft 14 and the rotational speed of the drive shaft 11 reaches an equilibrium state. The term "equilibrium state" means a state in which, due to a balance between the force of resistance upon the propeller 12 from the water and the frictional force of the forward clutch 31, the difference between the rotational speed of the propeller shaft 14 and the rotational speed of the forward gear 22 almost does not change. In the present preferred embodiment, the predetermined time period is fixed. For example, the predetermined time period is preferably set in advance to the time period required for the rotational speed of the propeller shaft 14 to reach a predetermined threshold value that is, for example, about 70% or greater and about 80% or less of the rotational speed of the forward gear 22. However, the predetermined time period is not limited to being fixed; it could also be variable.

Next, between the time point t2 and the time point t3, by inputting a command signal having a second command value V2 to the actuator 42, the control unit 73 causes the shift shaft 41 to shift from the first target position "F1" to the second target position "F2". The second command value V2 is greater than the first command value V1. The second command value V2 is a fixed value. In the present preferred embodiment, the second command value V2 is the maximum voltage value for the actuator 42. However, it would also be acceptable for the second command value V2 to be smaller than the maximum voltage value. Moreover, the second command value V2 is not limited to being fixed; it could also be variable.

When, in the interval between the time point t2 and the time point t3, the shift shaft 41 arrives at the second target position "F2", the forward gear 22 and the dog clutch 26 mesh together. At this time, the forward gear 22 and the dog clutch 26 mesh together smoothly, since the difference between the rotational speed of the forward gear 22 and the rotational speed of the dog clutch 26 has become small due to the synchronization control described above.

Thereafter, at the time point t3, the control unit 73 sets the command value for the actuator 42 to zero. Due to this the shift shaft 41 stops, and forward shifting is completed. It should be understood that, directly before the time point t3, the control unit 73 decreases the command value for the actuator 42. Due to this, by decelerating the shift shaft 41, it is possible to stop the shift shaft 41 rapidly.

During reverse shifting in which the dog clutch 26 and the reverse gear 23 mesh together as well, similar synchronization control is performed to the forward shifting described above. During reverse shifting, the first target position "F1" is the reverse intermediate position described above. The second target position "F2" is the reverse connection position described above. The control unit 73 is configured or programmed to control the actuator 42 by feedback control on the basis of the detection signal from the position detection unit 72, so that the shift shaft 41 shifts to the first target position "F1" and then to the second target position "F2". The command values for the actuator 42 during reverse shifting are the same as the command values during forward shifting, except for the fact that positive and negative are interchanged. Accordingly, detailed explanation of the control during reverse shifting will be omitted.

Figure 13:
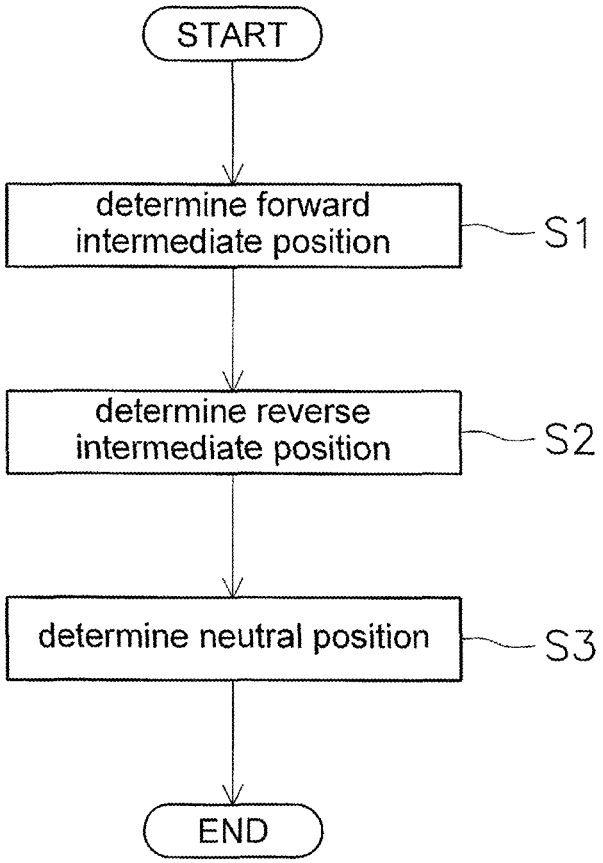
FIG. 13 is a flow chart showing a method for calibrating target positions for the shift shaft.

It should be understood that the neutral position, the forward intermediate position, and the reverse intermediate position of the shift shaft 41 described above may experience some influence from the accuracies of the various components. Accordingly, it is more desirable to set the value of each of these positions to an intrinsic value for each individual outboard motor 1, rather than setting all of them uniformly in advance for all outboard motors 1. In the following, a method of calibrating the target positions of the shift shaft 41 will be explained on the basis of FIG. 13.

First, in a step S1, the forward intermediate position is determined. Here, the control unit 73 controls the actuator 42, and drives the shift shaft 41 in the forward shifting direction. At this time, the command value for the actuator 42 is set in advance to a value such that, when the voltage and the temperature of the actuator 42 are in a standard state, a predetermined target pressing force is obtained for the forward clutch 31. For example, the command value for the actuator 42 may be set to the first command value V1 described above. The control unit 73 stores the position where the shift shaft 41 has stopped in a storage device as the forward intermediate position.

Next, in a step S2, the reverse intermediate position is determined. Here, the control unit 73 is configured or programmed to control the actuator 42, and to drive the shift shaft 41 in the reverse shifting direction. At this time, the command value for the actuator 42 is set in advance to a value such that, when the voltage and the temperature of the actuator 42 are in a standard state, a predetermined target pressing force is obtained for the reverse clutch 32. For example, the command value for the actuator 42 may be set to the value (−V1) obtained by negating the first command value V1 described above. The control unit 73 stores the position where the shift shaft 41 has stopped in the storage device as the reverse intermediate position.

Next, in a step S3, the neutral position is determined. Here, the control unit 73 is configured or programmed to determine the average value of the forward intermediate position that was determined in the step S1 and the reverse intermediate position that was determined in the step S2 as being the neutral position.

According to the preferred embodiments described above, by the control unit 73 controlling the actuator 42, it is possible to perform synchronization control whose accuracy is high with the friction clutches 31 and 32. Due to this configuration, it is possible to significantly reduce or prevent shift shock with a simple operation.

During synchronization control for forward shifting, the control unit 73 controls the actuator 42 so as to maintain the contacting state of the outer first clutch plates 33 and the inner first clutch plates 34 during the predetermined time period. The actuator 42 is controlled so that the frictional force between the outer first clutch plates 33 and the inner first clutch plates 34 remains constant. Due to this, it is possible to synchronize the forward gear 22 and the dog clutch 26 in a reliable manner.

Moreover, during synchronization control for reverse shifting, the control unit 73 controls the actuator 42 so as to maintain the contacting state of the outer second clutch plates 37 and the inner second clutch plates 38 during the predetermined time period. The actuator 42 is controlled so that the frictional force between the outer second clutch plates 37 and the inner second clutch plates 38 remains constant. Due to this, it is possible to synchronize the reverse gear 23 and the dog clutch 26 in a stable manner.

The predetermined time period is the time period until the difference between the rotational speed of the propeller shaft 14 and the rotational speed of the drive shaft 11 reaches an equilibrium state. Due to this, it is possible to synchronize the rotational speed of the propeller shaft 14 up to the overall upper limits of the transmission capabilities of the friction clutches 31 and 32. Due to this, it is possible to significantly reduce or prevent the occurrence of shift shock by making the difference between the rotational speed of the propeller shaft 14 and the rotational speed of the drive shaft 11 small.

The predetermined time period is preferably the time period until the rotational speed of the propeller shaft 14 reaches a predetermined threshold value that is, for example, greater than or equal to about 70% of the rotational speed of the drive shaft 11, and, moreover is less than or equal to about 80% thereof. Due to this, it is possible to significantly reduce or prevent the occurrence of shift shock more effectively, as compared with the case when the rotational speed of the propeller shaft 14 during synchronization is about 20% to about 30% of the rotational speed of the drive shaft 11. Moreover, it is possible to use friction clutches 31 and 32 whose transmission capabilities are smaller, as compared with the case in which the predetermined time period is the time period required for the rotational speed of the propeller shaft 14 to become the same as the rotational speed of the drive shaft 11. Due to this configuration, it is possible to make the friction clutches 31 and 32 more compact.

The control unit 73 controls the actuator 42 by feedback control on the basis of the detection signal from the position detection unit 72, so that the shift shaft 41 shifts to its first target position "F1" and then to its second target position "F2". Due to this, it is possible to execute synchronization control at high accuracy.

During synchronization control, the control unit 73 inputs a command signal including the first command value V1 to the actuator 42, while in the shifting stage the control unit 73 inputs a command signal including the second command value V2 to the actuator 42. The first command value V1 is smaller than the second command value V2. Accordingly, during synchronization control, the actuator 42 drives the shift shaft 41 with a smaller drive force than during the shifting stage. Due to this, it is possible to significantly reduce or prevent the occurrence of shift shock. To put the matter conversely, the second command value V2 for the shifting stage is greater than the first command value V1 during synchronization control. Due to this, it is possible to complete the shifting process rapidly.

The control unit 73 causes the shift shaft 41 to shift from the neutral position "N" to the first target position "F1" by inputting a command signal including the third command value V3 to the actuator 42. The third command value V3 is larger than the first command value V1. Due to this, it is possible to rapidly shift the shift shaft 41 from the neutral position "N" to the first target position "F1".

Although preferred embodiments of the present invention have been disclosed and explained above, the present invention is not to be considered as being limited to these preferred embodiments; various alterations are possible without deviating from the scope and the gist of the present invention.

For example, the reverse clutch 32 could be omitted. In other words, it would be acceptable only to perform synchronization with the forward clutch 31.

The friction clutches 31 and 32 are not limited to being multi plate type clutches; they could be clutches of some other type, such as single plate type clutches or the like.

The structure of the connection changeover mechanism 28 is not limited to being a structure that employs the sliding shaft 41, the first detent mechanism 45, and the second detent mechanism 46 as described above; it could be altered in various ways.

Figure 14:
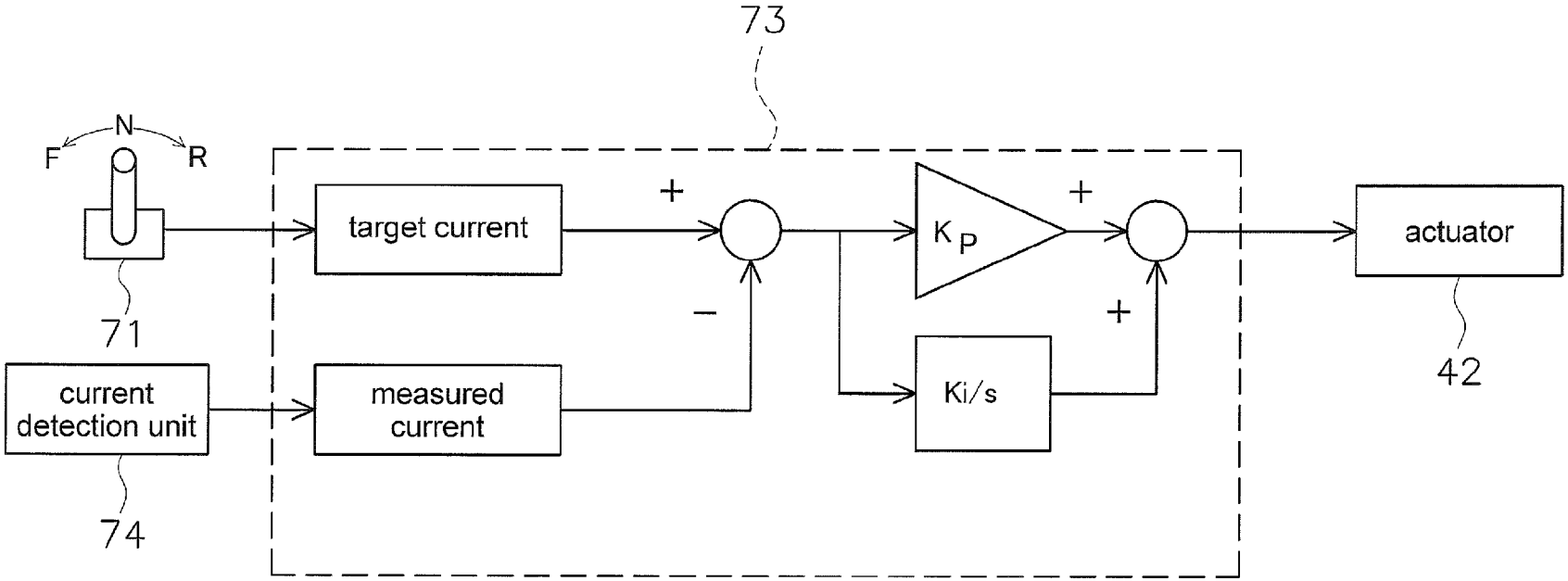
FIG. 14 is a block diagram showing a control system of an outboard motor according to a variant preferred embodiment of the present invention.

In the preferred embodiments described above, the control unit 73 is preferably configured or programmed to perform feedback control of the actuator 42 on the basis of the detection signal from the position detection unit 72. However, the control of the actuator 42 is not limited to being positional control; some other control method could be employed. For example, FIG. 14 is a block diagram showing a control system according to a variant preferred embodiment. As shown in FIG. 14, the outboard motor 1 is equipped with a current detection unit 74. The current detection unit 74 continuously measures the current in the actuator 42. The drive force of the actuator 42 changes according to the value of the current in the actuator 42. The control unit 73 is preferably configured or programmed to control the actuator 42 by feedback control on the basis of the detection signal from the current detection unit 74. With the control system according to this variant preferred embodiment, the command value described above is a command value for the current for the actuator 42.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

a drive shaft extending downward from the engine;

a drive gear fixed to the drive shaft;

a propeller shaft extending in a direction that intersects the drive shaft;

a forward gear meshed with the drive gear;

a reverse gear meshed with the drive gear;

a shift operating member that is operated to change between forward and reverse;

a dog clutch disposed on the propeller shaft, the dog clutch changing between connecting the forward gear to the propeller shaft and connecting the reverse gear to the propeller shaft by selectively meshing with the forward gear or the reverse gear according to an operation of the shift operating member;

a friction clutch including a first friction surface that transmits rotation of the drive shaft, and a second friction surface that transmits rotation of the propeller shaft, the friction clutch transmitting rotation of the drive shaft to the propeller shaft by the first friction surface and the second friction surface contacting together;

an actuator that drives the friction clutch; and a controller configured or programmed, before a shifting stage in which the dog clutch meshes with the forward gear or with the reverse gear, to execute synchronization control by controlling the actuator to contact the first friction surface and the second friction surface of the friction clutch together; wherein in the synchronization control, the controller is configured or programmed to control the actuator so as to maintain a contacting state between the first friction surface and the second friction surface during a predetermined time period.

2. The outboard motor according to claim 1, wherein the controller is configured or programmed to control the actuator so as to keep a frictional force between the first friction surface and the second friction surface constant during the predetermined time period.

3. The outboard motor according to claim 1, wherein the predetermined time period is a time period that it takes for a difference between a rotational speed of the propeller shaft and a rotational speed of the drive shaft to reach an equilibrium state.

4. The outboard motor according to claim 1, wherein the predetermined time period is a time period that it takes for a rotational speed of the propeller shaft to reach a predetermined threshold value that is between about 70% and about 80% of a rotational speed of the drive shaft.

5. An outboard motor comprising:

an engine;

a drive shaft extending downward from the engine;

a drive gear fixed to the drive shaft;

a propeller shaft extending in a direction that intersects the drive shaft;

a forward gear meshed with the drive gear;

a reverse gear meshed with the drive gear;

a shift operating member that is operated to change between forward and reverse:

a dog clutch disposed on the propeller shaft, the dog clutch changing between connecting the forward gear to the propeller shaft and connecting the reverse gear to the propeller shaft by selectively meshing with the forward gear or the reverse gear according to an operation of the shift operating member;

a friction clutch including a first friction surface that transmits rotation of the drive shaft, and a second friction surface that transmits rotation of the propeller shaft, the friction clutch transmitting rotation of the drive shaft to the propeller shaft by the first friction surface and the second friction surface contacting together;

an actuator that drives the friction clutch;

a controller configured or programmed, before a shifting stage in which the dog clutch meshes with the forward gear or with the reverse gear, to execute synchronization control by controlling the actuator to contact the first friction surface and the second friction surface of the friction clutch together; and a shift shaft that transmits operation of the actuator to the dog clutch and to the friction clutch; wherein the shift shaft shifts to a first target position and to a second target position;

contact between the first friction surface and the second friction surface starts in a state in which the shift shaft is positioned at the first target position;

the dog clutch and the forward gear mesh together in a state in which the shift shaft is positioned at the second target position; and the controller is configured or programmed to control the actuator so that the shift shaft shifts to the first target position and then to the second target position.

6. The outboard motor according to claim 5, further comprising:

a position detector that detects a position of the shift shaft; wherein the controller is configured or programmed to control the actuator by feedback control based on a detection signal from the position detector, so that the shift shaft shifts to the first target position and then to the second target position.

7. An outboard motor comprising:

an engine;

a drive shaft extending downward from the engine;

a drive gear fixed to the drive shaft;

a propeller shaft extending in a direction that intersects the drive shaft;

a forward gear meshed with the drive gear;

a reverse gear meshed with the drive gear;

a shift operating member that is operated to change between forward and reverse;

a dog clutch disposed on the propeller shaft, the dog clutch changing between connecting the forward gear to the propeller shaft and connecting the reverse gear to the propeller shaft by selectively meshing with the forward gear or the reverse gear according to an operation of the shift operating member;

a friction clutch including a first friction surface that transmits rotation of the drive shaft, and a second friction surface that transmits rotation of the propeller shaft, the friction clutch transmitting rotation of the drive shaft to the propeller shaft by the first friction surface and the second friction surface contacting together;

an actuator that drives the friction clutch; and a controller configured or programmed, before a shifting stage in which the dog clutch meshes with the forward gear or with the reverse gear, to execute synchronization control by controlling the actuator to contact the first friction surface and the second friction surface of the friction clutch together; wherein the controller is configured or programmed to input a command signal to the actuator according to a drive force of the actuator;

during the synchronization control, the controller is configured or programmed to input to the actuator a command signal including a first command value; and in the shifting stage, the controller is configured or programmed to input to the actuator a command signal including a second command value that is different from the first command value.

8. The outboard motor according to claim 7, wherein the first command value is smaller than the second command value.

9. The outboard motor according to claim 8, wherein the first command value is a fixed value.

10. An outboard motor comprising:

an engine;

a drive shaft extending downward from the engine;

a drive gear fixed to the drive shaft;

a propeller shaft extending in a direction that intersects the drive shaft;

a forward gear meshed with the drive gear;

a reverse gear meshed with the drive gear;

a shift operating member that is operated to change between forward and reverse;

a dog clutch disposed on the propeller shaft, the dog clutch changing between connecting the forward gear to the propeller shaft and connecting the reverse gear to the propeller shaft by selectively meshing with the forward gear or the reverse gear according to an operation of the shift operating member;

a friction clutch including a first friction surface that transmits rotation of the drive shaft, and a second friction surface that transmits rotation of the propeller shaft, the friction clutch transmitting rotation of the drive shaft to the propeller shaft by the first friction surface and the second friction surface contacting together;

an actuator that drives the friction clutch;

a controller configured or programmed, before a shifting stage in which the dog clutch meshes with the forward gear or with the reverse gear, to execute synchronization control by controlling the actuator to contact the first friction surface and the second friction surface of the friction clutch together; and a shift shaft that transmits operation of the actuator to the dog clutch and to the friction clutch; wherein the shift shaft shifts to a neutral position, to a first target position, and to a second target position;

in a state in which the shift shaft is positioned at the neutral position, the first friction surface and the second friction surface are not in contact, and the dog clutch and the forward gear are not meshed together;

contact between the first friction surface and the second friction surface starts in a state in which the shift shaft is positioned at the first target position;

the dog clutch and the forward gear mesh together in a state in which the shift shaft is positioned at the second target position;

the controller is configured or programmed to control the actuator so that the shift shaft shifts to the neutral position, to the first target position, and to the second target position;

the controller is configured or programmed to shift the shift shaft from the neutral position towards the first target position by inputting to the actuator a command signal including a third command value;

the controller is configured or programmed to execute the synchronization control to position the shift shaft to the first target position by inputting to the actuator a command signal including a first command value which is smaller than the third command value; and the controller is configured or programmed to shift the shift shaft from the first target position towards the second target position by inputting to the actuator a command signal including a second command value which is greater than the first command value.

* * * * *